US012716228B2

(12) United States Patent
Imvriotis

(10) Patent No.: US 12,716,228 B2
(45) Date of Patent: Aug. 25, 2026

(54) LOAD BEARING SYSTEM FOR A RESIDENTIAL STRUCTURE

(71) Applicant: NxGen Homes Pty Ltd, Botany (AU)

(72) Inventor: Alexander Imvriotis, Maroubra South (AU)

(73) Assignee: NxGen Homes Pty Ltd, Botany (AU)

( * ) Notice: Subject to any disclaimer, the term of this patent is extended or adjusted under 35 U.S.C. 154(b) by 187 days.

(21) Appl. No.: 18/398,076

(22) Filed: Dec. 27, 2023

(65) Prior Publication Data

US 2024/0183146 A1 Jun. 6, 2024

Related U.S. Application Data

(63) Continuation of application No. PCT/AU2022/050663, filed on Jun. 28, 2022.

(30) Foreign Application Priority Data

Jun. 28, 2021 (AU) ..... 2021901955

(51) Int. Cl.
*E04B 1/24* (2006.01)

(52) U.S. Cl.
CPC .... *E04B 1/2403* (2013.01); *E04B 2001/2415* (2013.01); *E04B 2001/2481* (2013.01); *E04B 2001/2484* (2013.01)

(58) Field of Classification Search
CPC ..... E04B 1/2403; E04B 2001/2415; E04B 2001/2481; E04B 2001/2484;
(Continued)

(56) References Cited

U.S. PATENT DOCUMENTS 2,936,051 A * 5/1960 Martin ..... E04B 1/24 52/651.07
5,205,101 A * 4/1993 Swan ..... E04C 3/08 52/126.1

(Continued)

FOREIGN PATENT DOCUMENTS

AU 2018100327 A4 4/2018
AU 2019201025 B2 10/2019

(Continued)

OTHER PUBLICATIONS

International Preliminary Report on Patentability Chapter II for PCT/AU2022/050663 (9 pages). (Year: 2023).*

(Continued)

*Primary Examiner* — Rodney Mintz
(74) *Attorney, Agent, or Firm* — Kilpatrick Townsend & Stockton LLP

(57) ABSTRACT

Disclosed is a load bearing system for a residential structure. The load bearing system comprises two or more structural load bearing columns, at least one beam extending between and connected with respect to in-use upper ends of the two or more structural load bearing columns, and at least one cladding panel mounted to extend between a foundation of the residential structure and the at least one beam. The columns are mounted to a foundation of the residential structure in spaced relation to the or each other column and comprise a periphery defined by hollow-section members and one or more internal bracing elements extending between the hollow-section members.

19 Claims, 32 Drawing Sheets

(58) Field of Classification Search
CPC ..... E04B 2001/2406; E04B 2001/2418; E04B 2001/2448; E04B 2001/2451; E04B 5/14; E04B 1/24; E04B 2001/2454; E04B 2001/246; E04B 2001/2466; E04B 2001/2472; E04B 5/10; E04B 2001/2457; E04B 2001/2463; E04B 2001/2469; E04C 2003/0491; E04C 2003/0408; E04C 2003/0473; E04C 2/46; E04C 3/04; E04C 3/32; E04F 2203/00; E04F 13/08; E04F 13/0875
See application file for complete search history.

(56) References Cited

U.S. PATENT DOCUMENTS

| | | | | |
|---|---|---|---|---|
| 5,289,665 | A * | 3/1994 | Higgins | E04B 5/43 52/655.1 |
| 5,664,388 | A * | 9/1997 | Chapman | E04C 3/065 52/745.1 |
| 5,761,873 | A * | 6/1998 | Slater | E04B 2/62 52/696 |
| 5,901,522 | A * | 5/1999 | Slater | E04B 1/24 52/645 |
| 5,904,025 | A | 5/1999 | Bass et al. | |
| 6,052,953 | A * | 4/2000 | Jewell | E04B 1/24 52/93.2 |
| 6,073,413 | A * | 6/2000 | Tongiatama | E04B 1/26 52/693 |
| 6,923,195 | B2 * | 8/2005 | Tseng | E04H 15/34 135/159 |
| 7,823,361 | B2 * | 11/2010 | Powers, III | F16L 3/24 52/691 |
| 8,171,696 | B2 * | 5/2012 | Powers, III | E04C 3/08 52/693 |
| 8,474,204 | B2 * | 7/2013 | Pan | E04B 1/30 52/650.1 |
| 8,615,957 | B1 * | 12/2013 | Sacks | E04C 3/08 52/654.1 |
| 9,752,323 | B2 * | 9/2017 | Sacks | E04C 5/065 |
| 10,323,419 | B2 | 6/2019 | Hatzinikolas | |
| 10,760,266 | B2 * | 9/2020 | Sacks | E04B 2/62 |
| 11,414,880 | B2 * | 8/2022 | Jie | E04B 5/023 |
| 11,713,576 | B2 * | 8/2023 | Hsieh | E04B 5/10 52/649.2 |
| 11,993,933 | B1 * | 5/2024 | Pitre | E04C 3/36 |
| 2005/0011156 | A1 * | 1/2005 | Tseng | E04H 15/34 52/633 |
| 2007/0125030 | A1 * | 6/2007 | Hoffmann | E04C 3/09 52/633 |
| 2008/0250747 | A1 * | 10/2008 | Johnson | E04C 3/16 52/693 |
| 2010/0126097 | A1 * | 5/2010 | Powers, III | E04C 3/07 52/745.19 |
| 2010/0230550 | A1 * | 9/2010 | Powers, III | F16L 3/24 248/74.1 |
| 2011/0016819 | A1 * | 1/2011 | Ro | E04B 5/10 52/649.2 |
| 2012/0186190 | A1 * | 7/2012 | Powers, III | E04C 3/08 52/836 |
| 2012/0304584 | A1 * | 12/2012 | Pan | E04B 1/165 52/655.1 |
| 2016/0298333 | A1 * | 10/2016 | Hsieh | E04C 3/08 |
| 2016/0305113 | A1 * | 10/2016 | Hatzinikolas | E04F 13/0801 |
| 2017/0030080 | A1 * | 2/2017 | Sacks | E04C 3/32 |
| 2019/0048583 | A1 * | 2/2019 | Sacks | E04B 2/62 |
| 2021/0095486 | A1 * | 4/2021 | Jie | E04B 5/10 |
| 2021/0131104 | A1 * | 5/2021 | Hsieh | E04B 1/2403 |

FOREIGN PATENT DOCUMENTS

| | | | |
|---|---|---|---|
| AU | 2020103551 | A4 | 2/2021 |
| AU | 2021269440 | A1 | 6/2022 |
| CN | 107178153 | A | 9/2017 |
| CN | 109853846 | A | 6/2019 |
| GB | 2142061 | A | 1/1985 |
| JP | 2000351424 | A | 12/2000 |
| JP | 2009097146 | A | 5/2009 |
| JP | 2017043905 | A | 3/2017 |
| WO | 2013005163 | A1 | 1/2013 |

OTHER PUBLICATIONS

Annex to the International Preliminary Report on Patentability Chapter II for PCT/AU2022/050663 (158 pages). (Year: 2023).*
International Search Report and Written Opinion of the International Searching Authority mailed Sep. 12, 2022 in International Patent Application No. PCT/AU2022/050663. 12 pages.
International Preliminary Report on Patentability mailed Jul. 10, 2023 in International Patent Application No. PCT/AU2022/050663. 200 pages.
Powertruss Wall Bracing System; "Powertruss PT Column—Image Gallery"; published on Jan. 23, 2019, as per Wayback Machine; [retrieved on Dec. 28, 2023; retrieved from the Internet: <https://web.archive.org/web/20190123180137/http://www.powertruss.com.au/powertruss-column-2/#prettyphoto[group-506]/14/>].
Anonymous; "Installation Options"; published on Mar. 1, 2015, as per Wayback Machine; [retrieved on Dec. 28, 2023; retrieved from the Internet: <https://web.archive.org/web/20150301123428/http://powertruss.com.au/wp-content/uploads/2013/12/Image_2_full.jpg>].
Ma, Jun et al.; "Effects of Precast Cladding Systems on Dynamic Characteristics of Steel Frame Buildings by Ambient and Free Vibration Tests"; Hindawi; Shock and Vibration; Published Apr. 13, 2017; vol. 2017, Article ID 5231727; 20 pages.

* cited by examiner

Fig. 10
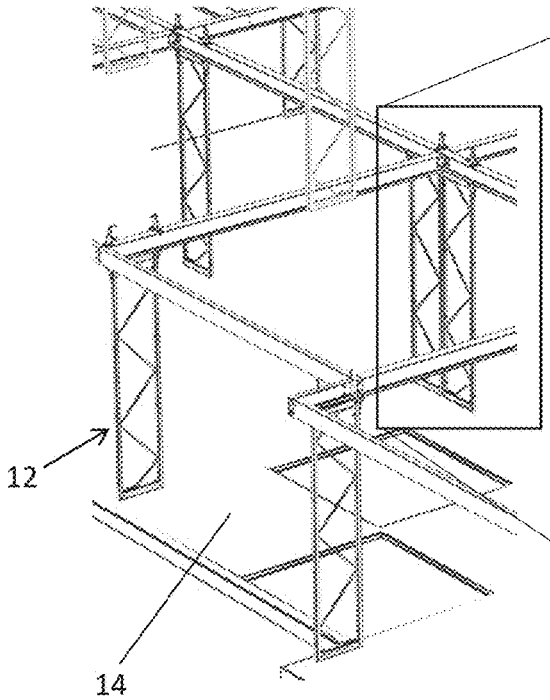
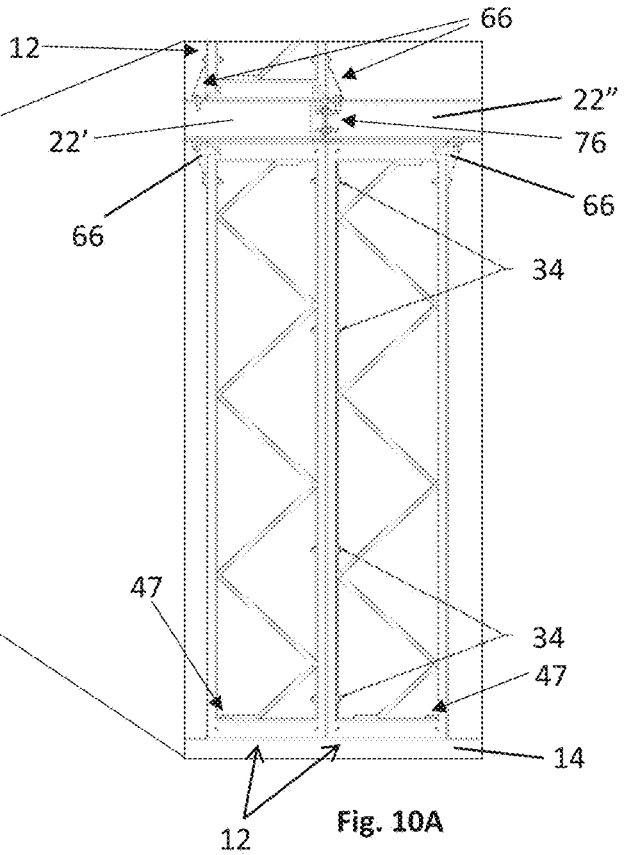
Fig. 10A

LOAD BEARING SYSTEM FOR A RESIDENTIAL STRUCTURE

CROSS-REFERENCES TO RELATED APPLICATIONS

This application is a continuation application of International Patent Application No. PCT/AU2022/050663 entitled "LOAD BEARING SYSTEM FOR A RESIDENTIAL STRUCTURE," filed on Jun. 28, 2022, which claims priority to Australian Patent Application No. 2021901955, filed on Jun. 28, 2021, all of which are herein incorporated by reference in their entirety for all purposes.

TECHNICAL FIELD

This disclosure relates to a load bearing system for a residential structure of a type that comprises façade panels mounted to an exterior of the structure. The load bearing system has particular use in the construction of single-storey, multi-storey and duplex-type structures. The load bearing system helps to facilitate modularisation of the construction process.

BACKGROUND ART

Load bearing systems for buildings and other structures are fundamental in providing structural integrity to support various loading conditions, e.g. wind loads, live and dead loads, etc.

The load bearing system can include columns and beams which are spaced about a foundation of the residential structure. The arrangement and configuration of the columns and beams can be determined by the design requirements of the structure.

In some cases, it may be desirable to position the columns and beams to suit certain styles of residential structure, for example, open plan kitchens, balconies, etc.

It is to be understood that, if any prior art is referred to herein, such reference does not constitute an admission that the prior art forms a part of the common general knowledge in the art, in Australia or any other country.

SUMMARY

Disclosed herein is a load bearing system for a residential structure. The load bearing system is not limited to use with a residential structure, rather it is particularly suitable for a residential structure. For example, a residential structure may include a single-storey residential structure, a duplex-type residential structure or a multi-storey residential structure. The load bearing system can help to facilitate modularisation of a construction process for the residential structure.

The load bearing system can comprise two or more structural load bearing columns. Each column can be for mounting to a foundation of the residential structure in spaced relation to the or each other column. The columns can be spaced from each other at predetermined locations on the foundation.

Each column can comprise a periphery defined by hollow-section members. The periphery can comprise opposing in-use vertical members and opposing in-use top and bottom chords. A lower end region of the column can be configured for being connected to an underlying part of the structure. An upper end region of the column can be configured for being connected to an overlying part of the structure.

One or more internal bracing elements can extend between the hollow-section members. The hollow-section members can, for example, be rectangular-hollow-section members, circular-hollow-section members, etc. The hollow-section members can be roll formed, hot-rolled, etc. (e.g. from steel such as mild steel). Each column may be prefabricated to be transported to a building site.

The number and position of the columns to be used at the building site may be predetermined/pre-calculated. For example, key components of the system may be prefabricated, and their arrangement at the building site may also be predetermined/pre-calculated.

The load bearing system can further comprise at least one beam extending between and connected with respect to the upper end region of the two or more structural load bearing columns. The beam can, for example, be connected to a given column and can be located at the upper end of the column. The beam can be connected to the upper end of the column, being distal to a lower end of the column, which can be mounted directly or indirectly to the foundation. Again, the number and position of the beams to be used at the building site may be predetermined/pre-calculated. The beams may also be prefabricated, or they may be cut to size on site.

The load bearing system can further comprise at least one cladding (i.e. façade) panel mounted to extend between the foundation of the residential structure and the at least one beam. The cladding panel can take the form of a façade panel. Such a panel can both enclose and enable decoration/completion of the residential structure, such as by being provided with various finishes (e.g. externally and internally of the façade panel). The cladding (façade) panels may again be prefabricated. The cladding panels can be fabricated with main weatherproofing features already integrated such that, when mounted between the foundation and the beam, the installed panels weatherproof the residential structure. When installed, the cladding panels can define an external wall of the residential structure. The ability to install cladding panels in this way can provide a rapid way of constructing an external wall of a residential structure.

As set forth above, the load bearing system can, at least to some extent, modularise construction of the residential structure. For example, once the columns and beams have been installed at the foundation, the cladding (façade) panels can be mounted. This can, for example, be enabled by lifting (e.g. by a crane) the panels into place. Once the panels have been installed, and once a roof (single storey) or second storey formwork (e.g. decking) has then been installed, the structure is essentially weatherproof, and works can commence on the interior of the residential structure.

As set forth above, the columns, beams, cladding (façade) panels, etc. can be prefabricated. Their sizing and configuration can also be predetermined. The requisite number and sizes of such components, along with any additional mounting accessories, can be packaged and may be supplied as a kit. The package/kit may be transported for installation at a worksite. Installation instructions may be supplied (e.g. in printed and electronic formats). The delivered components can then be rapidly installed onsite (e.g. at a preformed foundation, such as a concrete slab).

In some forms, each of the two or more columns of the residential structure may be elongate. Each column may have a depth such that it is able to be arranged, in use, inboard of the at least one cladding panel. For example, each column may be arranged towards an internal space, being the space defined by a perimeter of the foundation. The at least one cladding panel can be located at a front face of the column, for example, at an external side of the column relative to the internal space. The at least one cladding panel can be located at a side face of the column, for example, at an external side edge of the column relative to the internal space.

In some forms, the depth of each column may be such that it can be incorporated into a wall of the residential structure. For example, the depth of the column may be such as to enable the wall of the residential structure to substantially conform to typical wall thicknesses for residential structures. Thus, each column can provide a load-bearing function whilst being 'hidden' into a wall of the residential structure. This contrasts with prior art columns which are often either exposed, or they have a dimension such that, when incorporated into a wall of the residential structure, the resultant wall around the column is thicker than conventional and/or thicker than a remainder of the wall.

In some forms, the load bearing system may further comprise internal cladding. For example, the internal cladding may be a type of autoclaved aerated concrete (AAC), such as an AAC panel, suitable for an interior space of the residential structure. The internal cladding may instead comprise plasterboard, timber, or other suitable internal cladding materials. Various combinations of the aforesaid materials may be employed. The internal cladding may be mounted with respect to a back (or internal) face of each of the two or more columns (i.e. a face of the column that faces inwardly of the residential interior space). The internal cladding may be mounted with respect to a side face (e.g. a side edge) of each of the two or more columns. The internal cladding may be mounted with respect to the columns via a fixing system. For example, a known fixing system can employ a series of spaced 'top-hat' elongate profiles secured to span between adjacent columns, and to which the internal cladding may be fastened (e.g. by suitable fasteners, such as self-tapping screws, etc.).

Once the internal cladding is installed, each column may become incorporated into a wall of the residential structure, such as a wall that is defined by the at least one cladding (façade) panel and the internal cladding. For example, the column can be located (e.g. sandwiched) between an externally facing façade panel and internal cladding such as AAC, plasterboard, timber, etc. Typically, the internal cladding is installed on site, although the amount and location of the internal cladding to be used at the building site may be predetermined/pre-calculated.

The configuration of each column can enable internal cladding to be mounted (e.g. directly) to the column; this can simplify use of the system. In this regard, traditional residential structures typically require a framing system to be constructed along the perimeter of the foundation. Whilst the framing system can provide a load-bearing function separate to columns, the framing typically extends along or adjacent to each side of the foundation. The internal as well as external cladding is then mounted to the framing along each side of the foundation. In the load bearing system of the present disclosure, the internal cladding can be connected to each of the discretely spaced load bearing columns, and to span between the columns. For example, suitable cladding-mounting battens can be employed that span between adjacent columns. Further, the external cladding (i.e. façade) panels can be connected with respect to each of the discretely spaced load bearing columns via the at least one beam that extends between and connects with respect to the columns. Thus, the present system can avoid a traditional residential framing system, and the time and cost associated with the use of such framing systems.

In some embodiments, the residential structure may comprise at least four columns for mounting to the foundation in spaced relation to each other. For example, each column may be arranged to correspond to a corner of a room in the residential structure. Further, the at least four columns may be arranged such that they can be incorporated into four walls that form a room of the residential structure. Multiples of four columns for each of the rooms of the residential structure can be employed, although noting that some intermediate columns can be located at corners of adjacent rooms, and thus a single column can thereby simultaneously function as a column for both rooms.

In some embodiments, the residential structure may comprise at least four beams. Each beam may extend between and be connected with respect to the upper end region of at least two of the four columns. Again, some beams can be located at intermediate positions of the foundation along the borders of adjacent rooms, and thus a single beam can thereby simultaneously function as a beam for both rooms.

In the system, the beam-connected columns together can be arranged to form a ring-like (i.e. a polygonal ring-like) configuration. Further, the column-connected beams may structurally tie together the at least four columns (i.e. at the upper ends thereof). Cladding (i.e. façade) panels may then be mounted to extend between the foundation and at least some or each of the at least four beams in the ring-like configuration. Internal cladding may also be mounted to extend between the foundation and at least some or each of the at least four beams. Thus, the ring-like configuration of beam-connected columns can provide a framework for supporting both external and internal cladding. Further, as set forth above, the ring-like configuration of beam-connected columns can be prefabricated and erected quickly, thereby modularising, at least to some extent, construction of the residential structure.

In some forms, windows, doorways, vents, ducts, etc. can be arranged between two portions of a cladding panel. For example, a first portion of the cladding panel may be arranged below e.g. a window and may extend from the foundation to a lower side (e.g. underside) of the window. Further, a second cladding panel may be arranged above the window and may extend from an upper side of the window to a respective beam. In some other forms, a cladding panel may be entirely substituted by a window, doorway, etc. that extends between the foundation and the respective beam. The windows, doorways, vents, ducts, etc. may be prefabricated. Further, the windows, doorways, vents, ducts, etc. may be prefabricated into variations of the cladding panel (i.e. ready for immediate installation and in in the same manner as a cladding panel). For example, a cladding (façade) panel that already incorporates a window may be prefabricated, ready for installation once on site.

In some embodiments, at the foundation of the residential structure, at least some of the columns may be mounted at their in-use lower ends such that a front face thereof is parallel to and inset from an edge of the foundation. For example, the front face of the column may be inset from the edge of the foundation by a distance that generally corresponds to a thickness of a given cladding (façade) panel. This can enable the cladding panel, when mounted with respect to the column, to locate substantially flush with the edge of the foundation.

In some embodiments, at the foundation of the residential structure, at least some of the columns may be mounted at their in-use lower ends such that a front face thereof is perpendicular to an edge of the foundation. Further, a side (i.e. edge) face of the column may be inset from the edge of the foundation by a distance that generally corresponds to a thickness of a given cladding (façade) panel. Again, this can enable the cladding panel, when mounted with respect to the column, to locate substantially flush with the edge of the foundation.

When installing the columns, their spaced location with respect to the edge of the foundation, and with respect to each other, can be pre-marked (e.g. painted, etc. onto a slab of the foundation). This marking can be made according to a predetermined plan. Again, this can speed up the construction process.

In some embodiments, at the foundation of the residential structure, at least some of the columns (e.g. adjacent spaced columns) may be mounted at their in-use lower ends such that a front face thereof is one or more of:

perpendicular to a front face of an adjacent column;

aligned with a front face of an adjacent column;

parallel to a front face of an adjacent column.

Further, each of the columns may be inset from an edge of the foundation. Additionally, the first and second and adjacent columns can be arranged such that their front faces extend at any angle relative to an adjacent edge of the foundation. For example, the first and second adjacent perpendicular columns may be arranged such that one column is perpendicular and the other is parallel to at least one of the edges of the foundation. In other examples, the first and second adjacent perpendicular columns may be arranged at angles that are other than perpendicular or parallel to one or more edges of the foundation. For a square or rectangular footprint of the residential structure, where each of the rooms are square or rectangular, front faces of the columns may be aligned, parallel or perpendicular to each other and with the edges of the foundation. For rounded or angular footprints of the residential structure and rooms, other alignments of the columns to each other and with the edges of the foundation can be possible or desirable.

In some embodiments, at the foundation of the residential structure, at least some of the columns may be mounted at their in-use lower ends at an intermediate location that is spaced away from opposing and/or adjacent edges of the foundation. In other words, at least some of the columns can be positioned towards a middle and/or towards central axes of the foundation for providing structural load bearing towards the middle or centre of the residential structure.

In some embodiments, cladding for front and back faces of each of the intermediate columns may comprise internal cladding. The internal cladding, together with the column, can form an internal wall that can define spaces, boundaries, etc. in e.g. rooms of the residential structure. The internal cladding material can be as set forth above.

In some embodiments, both the front and back faces of at least some of the columns can comprise cladding (i.e. façade) panels. For example, such a column may be positioned at an intermediate location of the foundation but also be located external to the interior of the residential structure (e.g. the column may be located in an atrium). A column with façade panels located on both front and back faces can be suitable for external, e.g. outdoor or semi-outdoor use.

In some embodiments, each of the two or more columns may be elongate and may be rectangular-shaped in front elevation. Each column may have a side-to-side width that is greater than a front-to-back depth thereof. Advantageously, the depth (i.e. front-to-back thickness) of the column may be such as to allow the column to be incorporated into a wall, such that the total thickness of the wall does not exceed a typical wall thickness for a residential structure. Notwithstanding its reduced depth, such a column can be engineered to provide the requisite degree of load bearing in the residential structure.

In use of the system, the cladding (i.e. façade) panels, and internal cladding (e.g. AAC, plasterboard, timber, etc.) can be supported by the beams and columns of the load bearing system. In this regard, each of the external cladding panel and the internal cladding applies a local (e.g. dead) load onto the beams and columns. The local loads applied by each component of the external and internal cladding accumulate to a global load which is supported by the beams and columns, with this load being transferred through to the foundation. In some forms, the local loads acting on a cladding panel can include wind loading, or other environmentally-derived loads, such as rain. In some other forms, internal pressure within the residential structure can apply a local load to the internal cladding. These local loads are transferred from the cladding and internal cladding, via the beams and columns, accumulate into a global load applied to and transferred by the load bearing system (beams and columns) into the foundation.

In some embodiments, the two or more columns and the at least one beam may be arranged in use to support: (i) a roof of the residential structure; or (ii) a floor of an overlying storey of the residential structure.

In some forms, the residential structure may be a single-storey structure. A roof of the single-storey residential structure (i.e. in the case of (i), above), an in-use upper end of the at least one cladding panel for the single-storey may be mounted with respect to the at least one beam arranged in use to support the roof.

The at least one cladding panel for the single-storey may be mounted to the at least one beam arranged in use to support the roof by at least one intermediate beam. The at least one intermediate beam may be mounted to the at least one beam arranged in use to support the roof of the single-storey structure may be arranged to support the upper end of the at least one cladding panel such that the at least one cladding panel is mounted to the at least one intermediate beam.

The at least one intermediate beam arranged at the at least one beam supporting the roof, i.e. in the case of (i), may be an L-shaped bracket. In some forms, the at least one beam supporting the roof is a C-channel. Such L-shaped brackets find particular use in roof structures, the L-shaped brackets connecting between the cladding (façade) panels and the C-channel beam.

The at least one L-shaped bracket may be mounted (e.g. bolted) to the C-channel beams supporting the roof such that a flange of the L-bracket and a flange of the C-channel beam are in surface-to-surface contact, i.e. flange-to-flange. A first flange of the L-bracket can be connected to an in-use upper flange of the C-channel beam. As described above, an in-use lower flange of the at least one (C-channel) beam may be connected (e.g. bolted) to a respective column (e.g. to an upper end thereof).

A second flange of the L-bracket (i.e. that projects from the first flange) may be connected (e.g. bolted, screwed) to an upper end of the cladding (façade) panel. The second flange of the L-bracket can be generally parallel with the in-use cladding (façade) panel such that the second flange substantially contacts the cladding (façade) panel to be secured thereat.

In some forms of the roof of the single-storey residential structure, i.e. in the case of (i), the at least one L-shaped bracket and the at least one beam supporting the roof are each configured such that the in-use horizontal positioning of the at least one L-shaped bracket to the at least one beam supporting the roof is adjustable.

The spacing between the upper end of the cladding (façade) panels and the C-channel beams can be selected to allow the inwards and outwards (horizontal) positioning of the L-bracket (i.e. intermediate beam) to be adjusted relative to the at least one beam. In this way, the upper end of the cladding (façade) panel can be moved towards (i.e. inwards) or away (i.e. outwards) from the residential structure. This can allow the cladding (façade) panel to be adjusted in position with respect to a roof of a single-storey construction or a roof of a multi-storey construction.

Such adjustment can allow for the L-bracket to be positioned to accommodate the optimal arrangement for the upper end of the cladding (façade) panel. For example, once a cladding (façade) panel is positioned in a sub-sill at a respective beam and column, the L-bracket can be manoeuvred into position with respect to the C-channel beam such that the upper end of the cladding (façade) panel is in the optimal position (e.g. in a plumb position). The L-bracket can then be fixed in place with respect to the C-channel beam via e.g. bolted, screwed, etc connections.

In some forms of the roof of the single-storey residential structure, i.e. in the case of (i), the at least one L-shaped bracket is configured such that the in-use vertical positioning of the at least one cladding panel is adjustable.

The spacing between the upper end of the cladding (façade) panels and the L-bracket can be selected to allow the upwards and downwards (vertical) positioning of the cladding (façade) panel to be adjusted relative to the at least one beam. In this way, once a cladding (façade) panel is positioned in a sub-sill at a respective beam and column, the upper end of the cladding (façade) panel can be moved vertically towards (i.e. downwards) or vertically away (i.e. upwards) from the L-bracket (and the at least one beam). This can allow the cladding (façade) panel to be adjusted in position before being fixed in place with respect to a roof of a single-storey construction or a roof of a multi-storey construction via e.g. bolted, screwed, etc connections.

In some forms, the residential structure may be a multi-storey structure. For a floor of an overlying storey of the multi-storey residential structure (i.e. in the case of (ii), above), an in-use upper end of the at least one cladding panel for an underlying-storey may be mounted with respect to the at least one beam via a sub-head. The at least one beam may be arranged in use to support a floor of an overlying storey. The sub-head may be mounted with respect to the at least one beam. An in-use lower end of an at least one cladding panel for the overlying-storey may be mounted with respect to the at least one beam via a sub-sill. The sub-sill may be mounted with respect to the at least one beam.

In some forms of the floor of the overlying storey of the multi-storey residential structure, i.e. in the case of (ii), at least one intermediate beam may be mounted to the at least one beam arranged in use to support the floor of an overlying storey. The at least one intermediate beam may be arranged at the at least one beam supporting the overlying floor. The at least one intermediate beam may be arranged to support the sub-head and sub-sill for the at least one cladding panel such that at least one cladding panel underlies the at least one intermediate beam. The at least one intermediate beam may also be arranged to support the sub-head and sub-sill for the at least one cladding panel such that at least one cladding panel is supported above the intermediate beam.

In some forms of the floor of the overlying storey of the multi-storey residential structure, i.e. in the case of (ii), the at least one intermediate beam can also act/function as a fascia beam. As set forth below, the intermediate (fascia) beam can support a sub-head for an underlying cladding (façade) panel and also support a sub-sill for an overlying cladding (façade) panel in a multi-storey structure.

The at least one fascia beam may be mounted to the at least one beam supporting the floor of the overlying storey. The fascia beam may be arranged to support a sub-sill for an overlying at least one cladding panel of the overlying storey. The fascia beam may also be arranged to support a sub-head for an underlying at least one cladding panel of the underlying storey.

The sub-head may e.g. be screwed or bolted to the intermediate (fascia) beam. A web (or back plate) of the intermediate (fascia) beam may, in turn, be mounted to the at least one beam. For example, the web (back plate) of the intermediate (fascia) beam may be bolted to a web (or back plate) of the at least one beam. In this way, loads (e.g. wind and atmospheric loads) applied to the cladding (façade) panel can be transferred through to the column via the sub-head, the intermediate (fascia) beam and the at least one beam.

In some forms of the floor of the overlying storey of the multi-storey residential structure, i.e. in the case of (ii), each of the intermediate (fascia) beam and the at least one beam supporting the overlying storey may take the form of C-channels (also known as a PFC section—i.e. parallel flange channel section). The C-channels may be connected (e.g. bolted) to each other back-to-back (e.g. via their respective webs (or back plates). The sub-head may be connected to an in-use lower flange of the intermediate (C-channel) beam, being a flange that projects laterally in use from the intermediate beam web. Further, an in-use lower flange of the at least one (C-channel) beam that projects laterally in use from its web may be connected (e.g. bolted) to a respective column (e.g. to an upper end thereof).

In some forms of the floor of the overlying storey of the multi-storey residential structure, i.e. in the case of (ii), the at least one fascia beam and the at least one beam supporting the overlying storey are each configured such that the in-use vertical positioning of the at least one fascia beam to the at least one beam supporting the overlying storey is adjustable.

When each of the intermediate beam and the at least one beam are in the form of C-channels, the spacing between in-use lower and upper flanges of the intermediate beam may be selected to be greater than the corresponding spacing between in-use lower and upper flanges of the at least one beam. In use, this can allow the upwards and downwards (vertical) positioning of the intermediate beam to be adjusted relative to the at least one beam. Thus, the intermediate beam can be moved away from or towards the foundation. This can allow for adjustments to be made with respect to a roof of a single-storey construction, or with respect to the overlying cladding (façade) panels of a multi-storey construction.

Such adjustment can also allow for the top of the sub-head to be located vertically lower than a top of an adjacent column. During construction, a cladding (façade) panel can be pre-positioned, adjacent to a respective beam and column. The intermediate beam and sub-head can then be manoeuvred into position over the cladding (façade) panel, with the intermediate beam then being connected (e.g. bolted) to the at least one beam. In this way, the intermediate beam can cover the join between the underlying column and the at least one beam.

For a multi-storey construction, a sub-sill may be connected (e.g. screwed or bolted) to an in-use upper flange of the intermediate beam. This sub-sill can be configured to receive therein a cladding (façade) panel of the overlying storey. Again, as set forth above, the vertical height of the overlying sub-sill can be adjusted relative to foundation and the at least one beam. Again, in this way, the intermediate beam can cover the join between an overlying column and the at least one beam.

In some embodiments, the cladding (façade) panel of the overlying storey may be positioned to align with the cladding (façade) panel of the underlying storey.

In some forms of the multi-storey residential structure, at an overlying-storey the in-use upper end of the at least one cladding panel for the overlying-storey may be mounted with respect to the at least one beam for the overlying storey. In this form, the at least one overlying beam may be arranged in use to support the roof, i.e. in the case of (i).

In some further forms of the multi-storey residential structure, at the roof of the structure, i.e. in the case of (i), at least one intermediate beam may take the form of an L-bracket as described previously. That is, the L-bracket may be mounted to the at least one overlying beam arranged in use to support the roof of the multi-storey structure. The L-bracket may be arranged to support the upper end of the at least one cladding panel for the overlying-storey such that the at least one cladding panel is mounted to the at least one L-bracket.

In some forms of the multi-storey residential structure, the at least one overlying beam may take the form of a C-channel, as previously described. That is, the at least one L-shaped bracket can be mounted flange-to-flange to the at least one overlying C-channel beam.

In some forms, and as described previously, the at least one L-shaped bracket and the at least one overlying C-channel supporting the roof of the multi-storey structure can each be configured such that the in-use horizontal positioning of the L-shaped bracket the C-channel is adjustable.

In some forms, and as described previously, the at least one L-shaped bracket may be configured such that the in-use vertical positioning of the at least one cladding panel for the overlying-storey is adjustable.

In some embodiments, an in-use upper end of the at least one cladding (façade) panel is mounted with respect to the at least one beam via a sub-head. The sub-head can, for example, take the form of an extrusion (e.g. of aluminium) that has a profile configured to receive the upper end of the cladding panel therein. The sub-head may be mounted to the at least one beam via, for example, a bolted connection. For example, the sub-head may be mounted to the beam via an intermediate beam.

In some embodiments, each of the sub-head and sub-sill may further comprise fascia retention formations. In use, these formations can project laterally from each of the sub-head and sub-sill. The fascia retention formations can be arranged to enable at least one fascia panel to be mounted externally of the intermediate (fascia) beam. For example, the fascia retention formations can be configured to enable the fascia panel to be push-, press-, interference- or snap-fit onto the formations. Optional fasteners (e.g. screws/bolts) may be employed to further secure the fascia panel to the formations. When so mounted, the fascia panel can thereby cover a join. Such a join may be between the underlying storey and roof of the residential structure (single-storey construction), or it may be between the underlying and overlying storeys of the residential structure (multi-storey construction).

In this regard, the load bearing system may further comprise and be supplied with one or more such fascia panels. The fascia panels may be configured to have the same or a similar external appearance (e.g. surface finish) to the cladding (façade) panels. In this way, the fascia panels can 'finish' or 'cap off' external side(s) of the residential structure.

In some embodiments, an in-use lower end of the at least one cladding (façade) panel may be mounted with respect to the foundation via a sub-sill. The sub-sill can, for example, also take the form of an extrusion (e.g. of aluminium). The sub-sill can have a profile that is configured to receive the lower end of the cladding panel therein. The sub-sill may be mounted to the foundation by, for example, a bolted connection (e.g. via adhesively-bonded concrete anchor bolts).

In some embodiments, each cladding (façade) panel may further comprise in-use upper and lower retention formations that respectively project laterally from in-use upper and lower ends of each cladding panel. The retention formations can be arranged to enable an external surface finish support to be mounted externally of each cladding panel. The external surface finish support may take the form of: a profiled, optionally painted, metal sheet material; a sheet or plate with a textured surface, such as a surface that may be cement-rendered; an AAC panel; timber or polymer siding; etc.

In some embodiments, an in-use upper end of each of the two or more columns may be further coupled to the at least one beam via at least one bracket. Each bracket can be configured for supporting the columns and beam in torsional loading. Each bracket may be mounted (e.g. bolted) to the column upper end at a upper portion of a side (edge) face of the column. Each bracket may be mounted (e.g. bolted) to the at least one beam. When the at least one beam is in the form of a C-channel, each bracket may be mounted (e.g. bolted) to the in-use lower flange of the at least one beam.

In some forms, the two or more columns can be releasably mounted to the at least one beam and the foundation of the residential structure. This can allow for easy deconstruction of part or all the residential structure (e.g. as an alternative to demolition; or during renovations, such as residential extensions; or for relocation of the residential structure; etc.).

Typically, the two or more columns and the at least one beam are arranged in use to support a roof or a floor of an overlying storey of the residential structure. Again, in this way, the system is modular in that it can be deployed to form a single-storey residential structure, a duplex-type residential structure or a multi-storey residential structure.

In other embodiments, a formwork structure for the floor of the overlying storey may be mounted with respect to the at least one beam. For example, the formwork structure may be mounted (e.g. screwed or bolted) to the intermediate beam (e.g. to an upper flange thereof), with the latter being mounted (e.g. bolted) to the at least one beam. The formwork structure may comprise decking such as may provide a mould for concrete to be poured therein. For example, a type of formwork decking such as e.g. Bondek® (trade mark of Lysaght) may be used for the floor formwork to receive cementitious material therein.

In some embodiments, a floor support structure such as a floor frame structure may be mounted with respect to the at least one beam. The floor support structure can be configured for mounting of floorboards or floor panels thereto. For example, timber floorboards, composite panels, etc. may be mounted to the floor support structure to form the floor of the overlying storey.

Having constructed the floor of the overlying storey, the overlying storey may also be formed from two or more columns, the at least one beam connected with respect to the upper end region of the two or more columns, and at least one cladding (façade) panel mounted to extend between the floor of the overlying storey and the at least one beam.

The columns, beams and cladding (façade) panels of the overlying storey may be arranged and constructed in the same or a similar way to the columns, beams and cladding (façade) panels of the underlying storey. For example, the columns, beams and cladding (façade) panels at the perimeter of the overlying storey can directly align with the columns, beams and cladding (façade) panels at the perimeter of the underlying storey. This can allow for effective transfer of loads applied to both storeys through to the foundation.

However, different configurations and locations of internal columns, internal beams and internal cladding may be employed for the overlying storey in comparison to the underlying storey (although direct or indirect connections of overlying columns to the underlying beams may be required for effective load transfer). This can allow for e.g. different rooms, corridors, stairwells, etc. to be formed between the storeys.

In a typical arrangement of the multi-storey residential structure, an in-use lower end of each column of the overlying storey can be mounted (e.g. bolted) to at least one underlying beam of the underlying storey. The lower end of each column may be additionally mounted to the underlying beam via e.g. brackets as set forth above. As above, each bracket may be mounted (e.g. bolted) to the column lower end at a lower portion of a side (edge) face of the column, and each bracket may be mounted (e.g. bolted) to the at least one beam. When the underlying beam is a C-channel, each bracket may be mounted (e.g. bolted) to the in-use upper flange of the underlying beam.

In some embodiments, two or more columns may be arranged in side-by-side relation and mounted together (i.e. to be connected to each other to form a unit). The connected columns can provide for increased load-bearing capacity at given locations within a residential structure. For example, such increased load-bearing capacity may be required in multi-storey constructions, or where an overlying structure or component has increased weight, etc. To enable the two or more columns to be mounted together, a periphery (e.g. an outer frame) of each column may be provided with apertures therethrough which can facilitate the side-by-side mounting of the columns (e.g. by bolting through aligned apertures).

Also disclosed herein is a load bearing system for a residential structure. The system can be as outlined above. The system can comprise a plurality of structural load bearing columns (e.g. as outlined above). Each column can be mounted to a foundation of the residential structure in spaced relation to the or each other column. Each column can comprise a periphery defined by hollow-section members.

The periphery can comprise opposing in-use vertical members and opposing in-use top and bottom chords. A lower end region of the column can be configured for being connected to an underlying part of the structure. An upper end region of the column can configured for being connected to an overlying part of the structure.

One or more internal bracing elements can extend between the hollow-section members.

This system may further comprise a plurality of beams that extend between and are connected with respect to the upper end region of the structural load bearing columns, such as set forth above. The plurality of beams can be arranged end-to-end whereby the beams define a closed perimeter at the upper ends of the structural load bearing columns. The closed perimeter can take the form of a ring-like beam arrangement, whereby the beams together form rectangle, square, or another polygonal formation.

Also disclosed herein is a structural load bearing column. The column can be as set forth above. The column can comprise a periphery defined by hollow-section members and one or more internal bracing elements. The periphery can take the form of an outer frame that comprises opposing in-use vertical members and opposing in-use top and bottom chords. Each of the vertical members and the top and bottom chords can be of hollow section (i.e. as set forth above).

A lower end region of the column can be configured for being connected to an underlying structure. An upper end region of the column can be configured for being connected to an overlying structure.

The use of interconnected hollow sections can provide an extremely strong periphery for the column and can increase its load-bearing capacity. The one or more internal bracing elements can increase the torsional and 'twisting-resistance' capacity of the column.

The top and bottom chords may respectively extend between (e.g. be connected to) the opposing tops and bottoms of the vertical members. The vertical members can have a greater length (e.g. be considerably longer) than the top and bottom chords such that the column is elongate. Typically, the column has a rectangular shape when viewed in front-elevation.

In some embodiments, the vertical members and top and bottom chords may each be of rectangular hollow section. In other forms, the top and bottom chords may comprise rectangular hollow section, whereas the vertical members may comprise square-hollow-section. The hollow sections of the vertical members and top and bottom chords can be mitred and welded together at corners of the column to form the periphery (i.e. outer frame) of the column.

The one or more internal bracing elements can extend between (e.g. be connected to) the opposing vertical members. In some forms, the one or more internal bracing elements can also extend between (e.g. be connected to) the top and bottom chords.

The one or more internal bracing elements can each comprise a single rod, bar or member. When the internal bracing element is a member, it may take the form of a rectangular- or square-hollow-section (e.g. as set forth above, but typically of smaller cross-section). When the internal bracing element is a rod or bar, the rod or bar can be of a square section, circular section, or other suitably shaped-section. The rod or bar may be of solid section (e.g. of steel such as mild steel). The rod or bar can comprise a number of sections. These sections may be mitred and/or welded together.

In some embodiments, the one or more internal bracing elements may be arranged to extend between the opposing vertical members to define the column with a truss-like configuration. For example, an internal bracing element may be connected (e.g. welded or otherwise fastened) to the bottom chord. The bracing element may extend therefrom to connect (e.g. by welding or other fastening) to one of the vertical members. It may then extend back to connect (e.g. by welding or other fastening) to the opposing vertical member. The internal bracing element may continue in this way to extend, back-and-forth, between the vertical members in a type of 'zig-zag' configuration, up to and so as to connect (e.g. by welding or other fastening) to the top chord. In a specific embodiment, the bracing element may be arranged in the zig-zag formation whereby each back-and-forth 'run' of the bracing element is generally of equal size, and such that the angle between adjacent runs is constant. However, the lowermost and uppermost runs of the bracing element may be generally of half the size of the remaining runs.

In alternative embodiments, a number of spaced in-use horizontal rods, bars or members may each be connected (e.g. by welding or other fastening) at one end to one the vertical members and may each extend to connect (e.g. by welding or other fastening) at an opposite end to the opposing vertical member. In this form, the bracing elements are considered to be horizontal in-use relative to the vertical members (i.e. the horizontal internal bracing elements are orientated substantially parallel with the top and bottom chords). This can give the column a ladder-like appearance.

In some embodiments, when the column is viewed in front elevation, the bottom-to-top height of each of the top and bottom chords may be greater than the side-to-side width of the vertical members. In other words, when viewed in front elevation, the vertical members may be narrower than the top and bottom chords. In other embodiments, when the column is viewed in front elevation, the bottom-to-top height of each of the top and bottom chords may be less than the side-to-side width of the vertical members. In other words, when viewed in front elevation, the vertical members are wider than the top and bottom chords.

In either of these variations, typically the depth of each of the top and bottom chords and vertical members (i.e. column thickness) can be selected to be the same. As set forth above, this can allow for the column to be incorporated into a wall. Also, it can allow for fixing systems for internal cladding to be mounted to the column at various locations between and including the top and bottom chords.

Depending on the particular design for a residential structure, including specific loading conditions to which each of the columns may be subjected, different sizes of the hollow-sections for the vertical members and for the top and bottom chords can be selected. For example, for a single-storey construction, where overlying loads are less, smaller (e.g. square) hollow sections may be employed for each of the vertical members and top and bottom chords. For a multi-storey construction, where overlying loads are greater, larger (e.g. rectangular) hollow sections may be employed for at least the vertical members and optionally for the top and bottom chords. For residential structures that may be subjected to high wind and atmospheric loading, larger (e.g. rectangular) hollow sections may be employed for at least the top and bottom chords and optionally for the vertical members. The selection of the most appropriate configuration and size of the vertical members and top and bottom chords is typically undertaken with a view to ensuring proper distribution of stresses applied to the column and structure (i.e. through to the underlying foundation), and to optimise the overall load bearing capacity of each column, whilst not 'over-engineering' each column.

As set forth above, the periphery of the column may comprise a series of spaced apertures therethrough. These apertures can be sized and located to enable mounting of the column with respect to one or more of: a beam extending between in-use upper ends of spaced columns; brackets for joining to the beam; the foundation; a periphery of an adjoining (e.g. like) column.

As set forth above, the columns may be releasably mounted to other components of the system (e.g. beam, brackets, foundation, adjoining column, etc.). The releasable mounting may be facilitated by a bolted connection. Where the bolted connection needs to be strong (e.g. between the column and the foundation), larger (e.g. anchor such as chemical anchor) bolts may be employed. The releasable connection can allow for the various demounting scenarios as outlined above.

In some embodiments, the arrangement of the series of apertures on each of the opposing vertical members may be identical, such that the column and an adjoining column can be mounted together side-by-side and on either side thereof. This also allows each column to be rotated 180° about a vertical axis such that either vertical member can be mounted to an adjoining column.

Typically, the vertical members, top and bottom chords, and one or more internal bracing elements are each of metal, such as steel, steel alloy or aluminium, such that the components can be welded together to form the column.

Also disclosed herein is a method for constructing a residential structure. The method comprises mounting an in-use lower end of each of a plurality of structural load bearing columns, as set forth above, with respect to a foundation for supporting the residential structure. The columns may be releasably mounted (e.g. bolted) to the foundation.

The method also comprises securing a plurality of beams to extend between and be connected with respect to an upper end region of the plurality of structural load bearing columns. Each of the beams may be as set forth above. Each of the beam-to-column connections may be as set forth above. The plurality of beams may be arranged end-to-end, whereby the beams can define a closed perimeter at the upper ends of the columns.

As also set forth above, the plurality of columns and plurality of beams may be prefabricated and pre-sized and then transported to, for installation at, a worksite. The components may be supplied in kit form to be assembled onsite to thereby construct the load bearing system.

In some embodiments, the method may further comprise mounting a plurality of cladding (façade) panels with respect to the plurality of beams to extend between the foundation and the beams. The cladding panels can be as set forth above, and the mounting with respect to the beams can be as set forth above. The cladding panels can be mounted at and around a perimeter of the residential structure to thereby provide an external wall of the structure. The cladding panels can help to weatherproof the structure. In some forms of the method, windows, doorways, etc, can be mounted together with the panels, such as set forth above.

In some embodiments of the method, at least some of the columns may be mounted at a perimeter of the foundation of the residential structure. For example, the columns may be mounted adjacent to the perimeter but spaced from an edge of the foundation to accommodate the later (e.g. flush) mounting of the cladding panels.

In some embodiments of the method, at least some of the columns may be mounted to the foundation at an intermediate (inset) location that is spaced with respect to the foundation perimeter. For example, these columns may be arranged at or towards a middle of the foundation. These columns can provide both a load-bearing function, and can support internal walls, doorways, etc. in the residential structure.

In some embodiments of the method, internal cladding may be mounted with respect to the plurality of columns. The internal cladding may be as set forth above (e.g. it can take the form of AAC, plasterboard, timber or other material suitable for internal cladding). As set forth above, the internal cladding may be indirectly mounted to the columns such as by fixing systems.

In some embodiments of the method, each column may become incorporated into a wall of the residential structure. For example, each column may be located between at least one cladding (façade) panel arranged at an external face of the column and internal cladding arranged at an opposing internal face of the column. Alternatively, each column can be incorporated into a wall of the residential structure to be located between internal cladding arranged at each of the external and internal faces of the column. In a further alternative, each column may be located between cladding (façade) panels located at front and back faces of the column. Otherwise, the method may be adapted as per the system as set forth above

BRIEF DESCRIPTION OF THE DRAWINGS

Embodiments will now be described by way of example only, with reference to the accompanying drawings in which:

FIG. 9D shows a detailed view of a beam and an intermediate beam; FIG. 9E shows a further detail of the beam and an intermediate beam of FIG. 9D; FIG. 9F shows a detailed view of a beam and an intermediate beam at a roof of the residential structure; FIG. 9G shows a detailed view of a beam and a cladding panel at a roof of the residential structure.

FIG. 10 shows a portion of a load bearing system for a ground level of a residential structure, and FIG. 10A shows a detail of FIG. 10, being an arrangement of structural load bearing columns.

DETAILED DESCRIPTION

Figure 1:
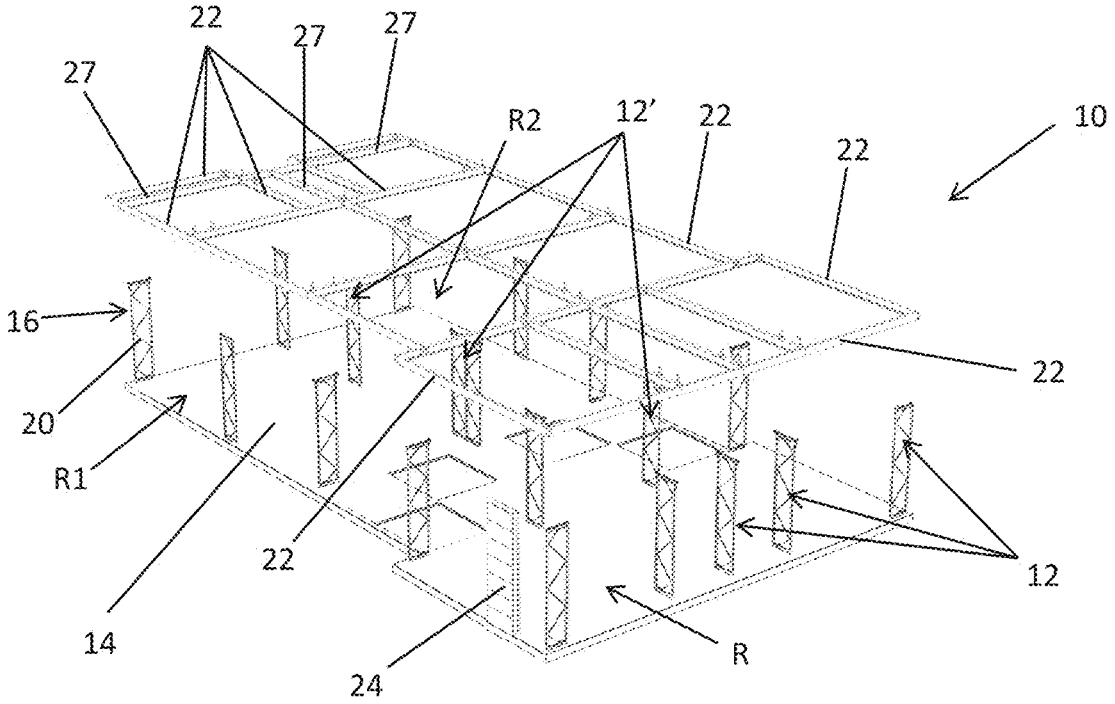
FIG. 1 shows an exploded view of a load bearing system for a ground level of a residential structure.

In the following detailed description, reference is made to accompanying drawings which form a part of the detailed description. The illustrative embodiments described in the detailed description, depicted in the drawings and defined in the claims, are not intended to be limiting. Other embodiments may be utilised and other changes may be made without departing from the spirit or scope of the subject matter presented. It will be readily understood that the aspects of the present disclosure, as generally described herein and illustrated in the drawings can be arranged, substituted, combined, separated and designed in a wide variety of different configurations, all of which are contemplated in this disclosure.

FIG. 1 illustrates a load bearing system for a residential structure 10. It should be understood that the load bearing system is not limited to application in the residential sector, and can be used and adapted to the commercial, industrial and other sectors. In this case, the load bearing system comprises multiple structural load bearing columns in the form of truss columns 12. As explained in further detail hereafter (such as in FIG. 14A), each truss column 12 is configured for mounting (e.g. by being bolted such as via chemical anchor bolts) to a foundation 14 of the residential structure. The foundation 14 can take the form of a reinforced concrete slab, etc. The truss columns 12 are spaced apart from each other according to the design requirements of the residential structure. In this regard, discretely spaced truss columns 12 can be arranged around a perimeter of the foundation 14, and intermediate, spaced truss columns 12' can be arranged internally of the foundation 14.

The intermediate truss columns 12' can support roof/ceiling spans for an overlying roof or upper storey of the structure. As explained below, the intermediate truss columns 12' can support beams that extend across the foundation (e.g. partially or fully from one side to the other). As also explained below, the intermediate truss columns 12' can be incorporated into internal walls of the residential structure (e.g. by being sandwiched between internal cladding mounted to front and back faces of the intermediate columns). Likewise, the perimeter truss columns 12 can be incorporated into external walls of the residential structure (e.g. by being sandwiched between external and internal cladding mounted respectively to front and back faces of the perimeter columns). As further explained below, the perimeter and intermediate truss columns 12, 12' can support fixing systems for internal cladding that can define spaces, e.g. rooms, partition walls, etc. within the residential structure.

In some forms, the intermediate columns 12' can be configured to support external cladding panels (i.e. façade panels) on their front and back faces. For example, the residential structure 10 may include e.g. an atrium whereby the internal walls (and intermediate columns) are ideally configured with external façade panels that are normally employed at the perimeter of the structure (i.e. for outdoor or semi-outdoor use).

Figure 7:
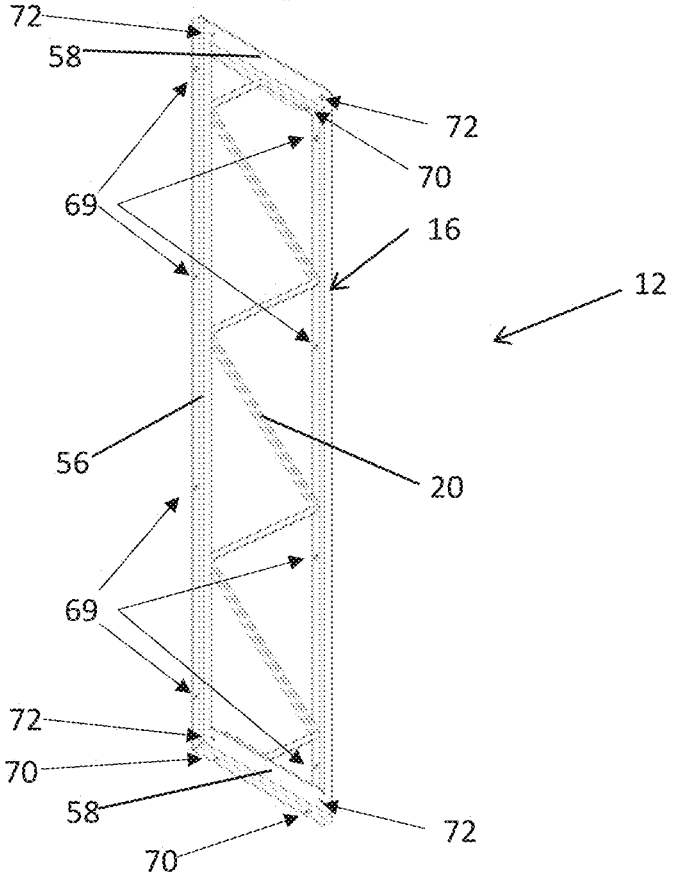
FIG. 7 shows a structural load bearing column of a load bearing system for a residential structure.

FIGS. 7 and 8 show in more detail that each truss column 12, 12' (hereafter designated '12') comprises a periphery in the form of an outer frame 16, the frame being defined by hollow-section members 18. Each truss column 12 has an elongate, rectangular form (i.e. when viewed in front elevation). Each truss column 12 also comprises one or more internal bracing elements which, in this embodiment, take the form of a single 'zig-zag' truss brace 20 that extends between the hollow-section members 18 as shown. In other embodiments (see e.g. FIG. 18 described below) the internal bracing can take a different form. FIG. 8 illustrates the truss column 12 orientated horizontally (i.e. not in an in-use orientation) for the purposes of clarity/description only.

Figure 8B:
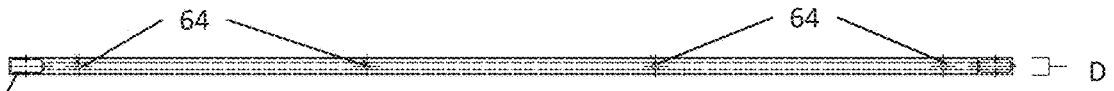
FIG. 8B shows a sectional side view through Z-Z of a structural load bearing column of a load bearing system for a residential structure.
Figure 8A:
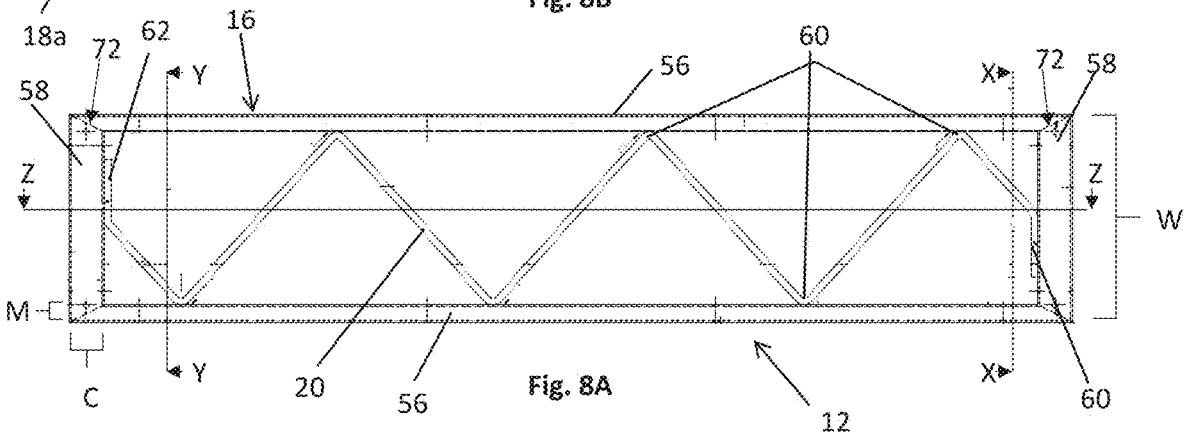
FIG. 8A shows a front elevation of a structural load bearing column of a load bearing system for a residential structure.
Figure 8C:
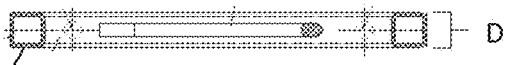
FIG. 8C shows a sectional end view through Y-Y of a structural load bearing column of a load bearing system for a residential structure.
Figure 8D:
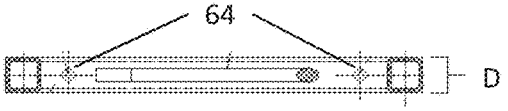
FIG. 8D shows a sectional end view through X-X of a structural load bearing column of a load bearing system for a residential structure.

As best shown in FIGS. 8B, 8C and 8D, and as described in more detail below, the hollow-section members 18 for the top and bottom chords of the truss column 12 comprise rectangular hollow-section members 18*a*, whereas the hollow-section members 18 for the long sides of the truss column 12 comprise square-hollow-section members 18*b*. The square-hollow-section members 18*b* define vertical members 56. The rectangular hollow-section members 18*a* define top and bottom chords 58. Each of the vertical members 56 and top and bottom chords 58 are mitred at their corners and are typically fixed together at the mitre-joints by a welded connection.

The truss brace 20 is typically formed from a single, circular-section rod which extends between the opposing vertical members 56 and the top and bottom chords 58. As above, the single rod is bent so as to extend up from the bottom chord 58, between the vertical members 56 in a zig-zag configuration, to connect to the top chord 58. In this way, the internal bracing 20 defines a plurality of apexes 60 at each of which the truss brace 20 is welded to the vertical members 56. Distal ends 62 of the truss bracing 20 are bent so as to be arranged parallel with the top and bottom chords 58. Typically, the distal ends 62 are welded (or riveted, etc.) in position at the top and bottom chords 58. The internal bracing 20 defines column 12 as a 'truss'.

The design and engineering of each truss column 12 is such that it has a high load-bearing capacity for a relatively small footprint. In this regard, the use of hollow-section members for each of the top and bottom chords and long sides of the outer frame 16, along with the truss brace 20 that extends between the hollow-section members 18, means that an elongate but comparatively 'shallow' (i.e. reduced depth/thickness) column structure can be manufactured, supplied and used. As explained below, this advantageously allows each truss column 12 to be incorporated into a wall of the residential structure 10 (be that an externally or internally arranged wall).

FIGS. 8A to 8D also show that each truss column 12 has a side-to-side width 'W' that is greater than a front-to-back depth 'D' thereof. As explained in further detail below, having a depth that is substantially smaller that the width allows the truss column to be incorporated and 'hidden' into a wall (i.e. the dimensions of the wall do not need to change in order to accommodate the truss column therein). This allows each truss column to perform its load-bearing function whilst concealed within a wall, providing structural integrity to the residential structure without occupying floor space (i.e. space that a larger, pre-existing and typical load bearing column would require). Thus, each truss column 12 can be seen as having a 'slender' form whilst still be able to meet load-bearing standards.

In addition, when the truss column 12 is viewed in front or rear elevation view, the bottom-to-top height of each of the top and bottom chords 58 (dimension 'C'), is greater than the side-to-side width of the vertical members 56 (dimension 'M'). This configuration is beneficial for supporting the column under bending load, such as dynamic and e.g. wind loads. The relatively larger bottom to top height of the chords 58 also assists in the distribution of stress under bending loads.

Referring again to FIG. 1, a number of beams 22 are arranged to extend between upper ends of the discrete, spaced truss columns 12. FIG. 1 shows the beams 22 connected together into a framework (i.e. 'portal framework'), but in FIG. 1 the framework of beams is shown in an 'exploded' (i.e. separated) arrangement from the multiple spaced truss columns 12. FIGS. 3 to 5 & 15 show the framework of beams in their connected arrangement with respect to the multiple spaced truss columns 12.

In this regard, when connected, the beams 22 serve to tie together the upper ends of the multiple spaced truss columns 12, thereby providing one or more ring-like, load-bearing and securing structures at the upper ends of the truss columns. The so-arranged beams 22 can provide a supporting framework for a roof or for an overlying (upper) storey(s) of the residential structure 10, including for the floor thereof. As above, the so-arranged beams 22 can define a portal frame that is self-supporting and does not require e.g. propping.

In use, as soon as the truss columns 12 have been fixed in situ to the foundation 14 (see FIG. 14A), upper ends of the truss columns can be connected together by the beams 22 to create a rigid framework structure. Such a structure is self-supporting and is now ready to support cladding panels in the form of façade panels 24, as well as internal cladding, as set forth below.

FIG. 1 also shows how the arrangement of beams 22 forms multiple ring-like structures throughout the residential structure 10. For example, beams 22 arranged around the perimeter of the residential structure form a main ring-like structure. Internal beams 22 combine with the perimeter beams and/or other internal beams to form smaller ring-like structures that generally correspond to internal walls and rooms located within the perimeter of the residential structure.

In the form shown in FIG. 1, the beams are, in general, directly connected to an upper end of at least one of the truss columns 12. However, in some cases (see e.g. beam 22' in FIG. 1A), one end of a beam (22') may be connected indirectly to a truss column (12') via another beam (22"). Or both ends of a beam may be connected indirectly to spaced truss columns. In yet other forms, a number or all of the beams can connect indirectly with respect to the truss column upper ends (e.g. such as to be offset from each upper end) and so as to accommodate other structural elements.

In the embodiments shown, the beams 22 take the form of Parallel Flange Channel Section (PFC), i.e. a C-channel beam. However, the beams may have other forms such as a Universal Beam (UB), i.e. I-beam. The number and types of beams used throughout the residential structure can be strategically designed, selected and located in terms of the room layout and load bearing requirements. That is, the number and location of truss columns 12 and beams 22 is selected and optimised towards minimising the overall weight and size of the column-beam structure as much as possible, but without compromising load-bearing capacity. For example, I-beams provide better load bearing capacity than an equivalent C-channel beam, however, I-beams are heavier than the equivalent C-channel beam. In this way, the weight of the structure can be reduced by generally employing C-channel beams and minimising (or eliminating) the number of I-beams used. In some situations (e.g. long spans), one or more I-beams may be employed.

Figure 1A:
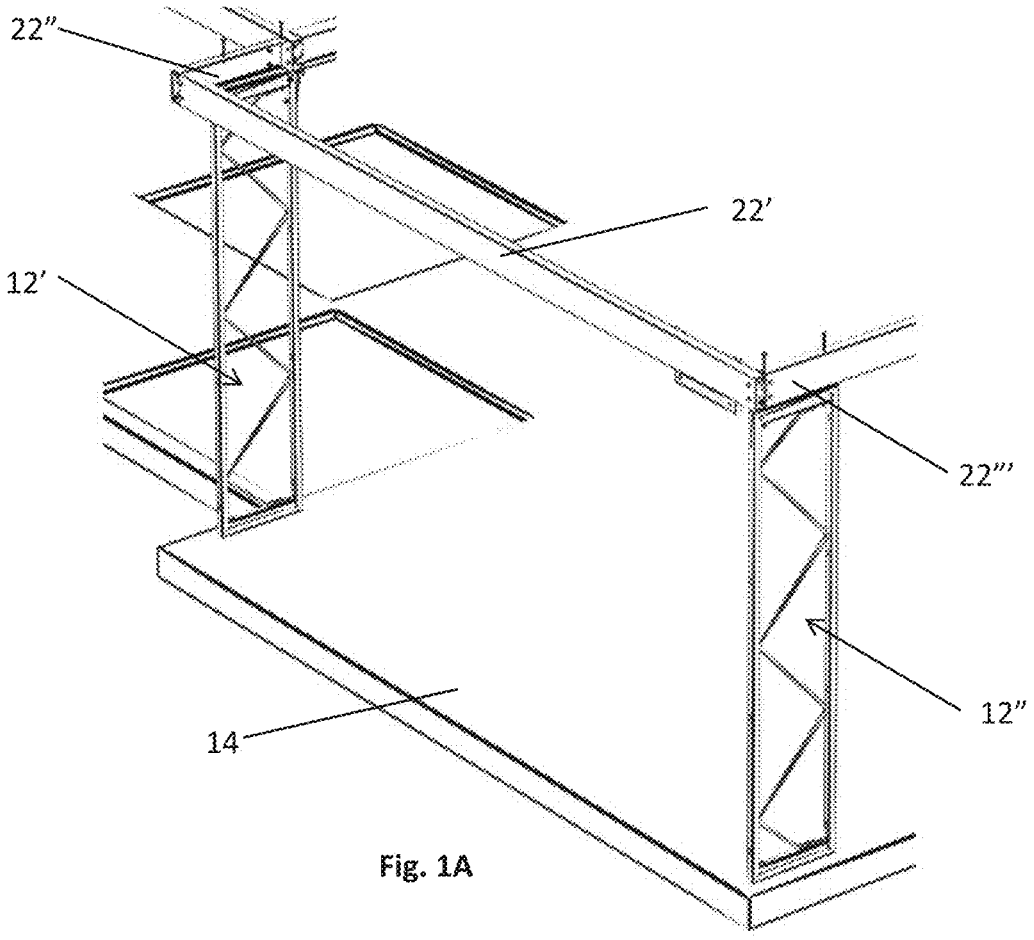
FIG. 1A shows a portion of a load bearing system for a ground level of a residential structure.

In a simple form, a single beam 22 is connected with respect to two truss columns 12. This simple arrangement could be employed to define a stand-alone wall. As shown in FIG. 1A, in some cases, a beam 22' can extend between two spaced apart beams 22" and 22''', wherein the two spaced apart beams are connected respectively to upper ends of truss columns 12' and 12". In this case, the beam 22' that extends between the two spaced apart beams 22", 22" is also connected 'with respect' to the two spaced apart beams, but as set forth above, need not be directly connected to the truss columns. In this case, one end of beam 22' connects only to an end of beam 22", with the beam 22" then being directly connected to the truss column 12'. An opposing end of beam 22' connects to an end of beam 22''' but can also be connected to the truss column 12". Many other permutations are possible.

Referring again to FIG. 1, typically a room R in the residential structure 10 comprises at least four truss columns 12. FIG. 1 shows a ground floor/lower storey in which multiple truss columns 12 are mounted to the foundation 14 in spaced relation to each other. Adjacent rooms can share two of the four truss columns. Some internal as well as some intermediate perimeter rooms can share all four truss columns with adjacent rooms. For a given room R, the truss columns 12 are configured to support the at least four beams 22. For some rooms (e.g. the end rooms R1 and R2 of the residential structure), the truss columns 12 can support additional beams 27. These additional beams may be employed to define stairwells, overhanging (cantilevered) verandas, light-wells, etc. As set forth above, when connected together, the truss columns 12 and beams 22, 27 form a type of portal frame.

As explained above, together the truss columns 12 and beams 22 define a load-bearing system. Such a system is designed and fabricated to support and accommodate various loads applied to the residential structure, including loads applied by: the roof; overlying storey(s); external and internal cladding; decking and verandas; live loads (e.g. people occupying the residential structure); dead loads (e.g. furniture; furnishings; appliances; solar panels and solar hot water; etc.); dynamic loads, such as wind, rain, loads resulting from internal pressure, etc. Each such load is applied 'locally' and is applied either directly or indirectly to the load-bearing system. The local loads are transferred collectively into the load bearing system, which on-transfers the loads through to the foundation 14 of the residential structure 10. In other words, the locally-applied loads (local loads) accumulate into a global load applied to the load-bearing system (i.e. to the truss columns 12 and beams 22), with the global load being transferred and applied to the foundation of the residential structure.

As set forth above, the load bearing system further comprises at least one cladding panel. Each cladding panel can take the form of a façade panel 24. The façade panels 24 can be considered "load-bearing" in the sense that each panel can distribute live loads, such as wind, rain, etc., into the truss columns 12 and beams 22 of the load-bearing system. The façade panels 24, as well as internal cladding, also apply a dead load onto the truss columns 12 and beams 22.

At a lower storey, each façade panel 24 is mounted to at least one beam 22 and is configured to extend therefrom down to the foundation 14 of the residential structure 10. At an upper storey, each façade panel 24 is mounted to at least one (uppermost) beam 22 and is configured to extend therefrom down to a floor of the upper storey. The façade panels 24 enclose the residential structure and can provide a support for decorative finishes to be applied (e.g. mounted) to the residential structure. In this regard, each façade panel 24 can be prefabricated, fully engineered and in a finished form such that, once installed, it can immediately function to help weatherproof the residential structure 10. The façade panels 24 can also be prefabricated with various: timber-, stone-, metallic-like external surface finishes applied thereto, or such finishes may be applied on site (e.g. to allow for multiple different finishes to be applied around the structure).

Figure 2:
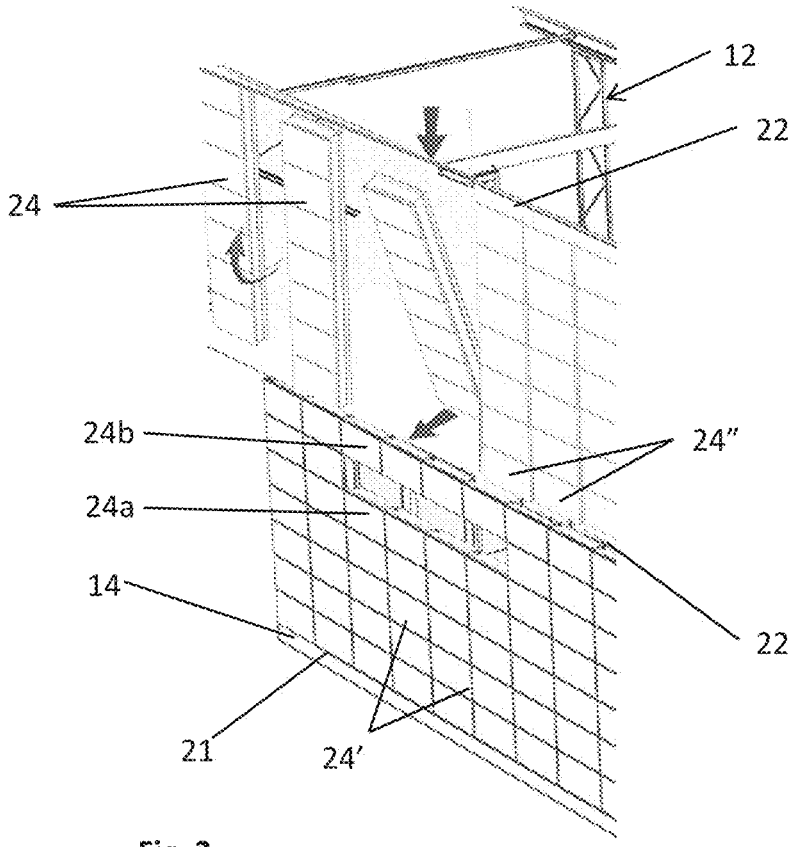
FIG. 2 shows a portion of a load bearing system for a ground level of a residential structure.

Referring now to FIG. 2, each of the truss columns 12 is configured to have a depth, i.e. a thickness, such that the columns 12 can be arranged immediately inboard of one or more façade panels 24. In FIG. 2, three of the façade panels 24 are shown in a 'lifted' orientation to illustrate their installation (e.g. lifting from an inside of the residential structure) to be arranged at a front face of a given one of the truss columns 12. The resultant wall thickness (façade panels 24+truss column 12) is not different to a conventional wall frame structure. As set forth above, the narrow depth (thickness) of each truss column 12 is such as to allow each column to be incorporated into (i.e. hidden within) a wall of the residential structure, and yet still be able to provide both its load-bearing function, as well as a support for external and internal cladding. In other words, each truss column 12 is thin enough such that, when incorporated into a wall, it does not increase the thickness of the wall when compared to either a non-load-bearing wall, or a wall that provides only a minimal load-bearing function. This can eliminate the need for columns to be manufactured and/or installed that are separate to the wall frame itself. Typically, such known columns have a much larger footprint and/or weight than an adjacent (e.g. timber or steel) wall frame. The use of truss columns 12 can thereby eliminate the use of known columns and e.g. timber or steel wall frames.

FIG. 2 also illustrates the position of adjacent façade panels 24' (i.e. once installed). It will be seen that the installed façade panels 24' are either flush with an edge 21 of the foundation 14 and/or are flush with an outer face of a beam 22 (e.g. when the panels 24 are being mounted to an overlying storey in a residential structure). FIG. 2 further illustrates an alternative positioning of façade panels 24" (i.e. once installed) whereby a lower end of the panels 24" is located adjacent to but 'outboard' of the foundation edge 21 and/or 'outboard' of an outer face of beam 22. This alternative installation arrangement may be employed when the panels 24" are being mounted to an overlying storey in a residential structure and/or to achieve a different aesthetic effect (e.g. to break up a wall of the residential structure). This alternative installation arrangement may be employed when a fill medium (e.g. insulation and/or a sound attenuation panel such as of AAC) is to be mounted between the panels 24" and truss columns 12.

In each case, each truss column 12 is typically located and spaced within the residential structure to be inboard relative to the façade panels 24, usually spaced/inset by at least a thickness of the façade panel. Further, in each case, the truss column 12 can be incorporated into, to thereby become an integral part of, the external wall of the residential structure (i.e. sandwiched between façade panels and internal cladding). As set forth above, typically the resulting external wall that incorporates the truss column 12 can have the same or similar thickness to a conventional frame wall that is externally and internally clad.

For example, a known (typical) structural column for a residential structure can be sized with a front to back depth of 100 mm. The truss column 12 for the load bearing system 10, by comparison to a typical structural column, is significantly reduced in depth. For example, the truss column 12 can be sized with a depth of 50 mm. This is a dimension that allows the column to readily be incorporated into a wall. Further, because of its structure, the load-bearing capacity of the truss column 12 is not compromised by such 'slender' dimensions.

As above, two (or more) spaced truss columns 12 can replace a typical wall frame that runs for a length of the residential structure perimeter (along each side of the residential structure perimeter). In addition, adjacent spaced truss columns 12 can support a known fixing system for internal cladding that is to be mounted to span between the adjacent, spaced truss columns 12. For example, an internal cladding fixing system can be affixed (e.g. by fasteners and/or adhesive) that comprises elongate battens. Each batten can be fixed at its opposing ends to a respective truss column. The battens can take the form of a plurality of spaced, horizontally extending elongate top-hat style (e.g. perforated) profiles to which the internal cladding can be fastened (e.g. by self-tapping screws).

Figure 3:
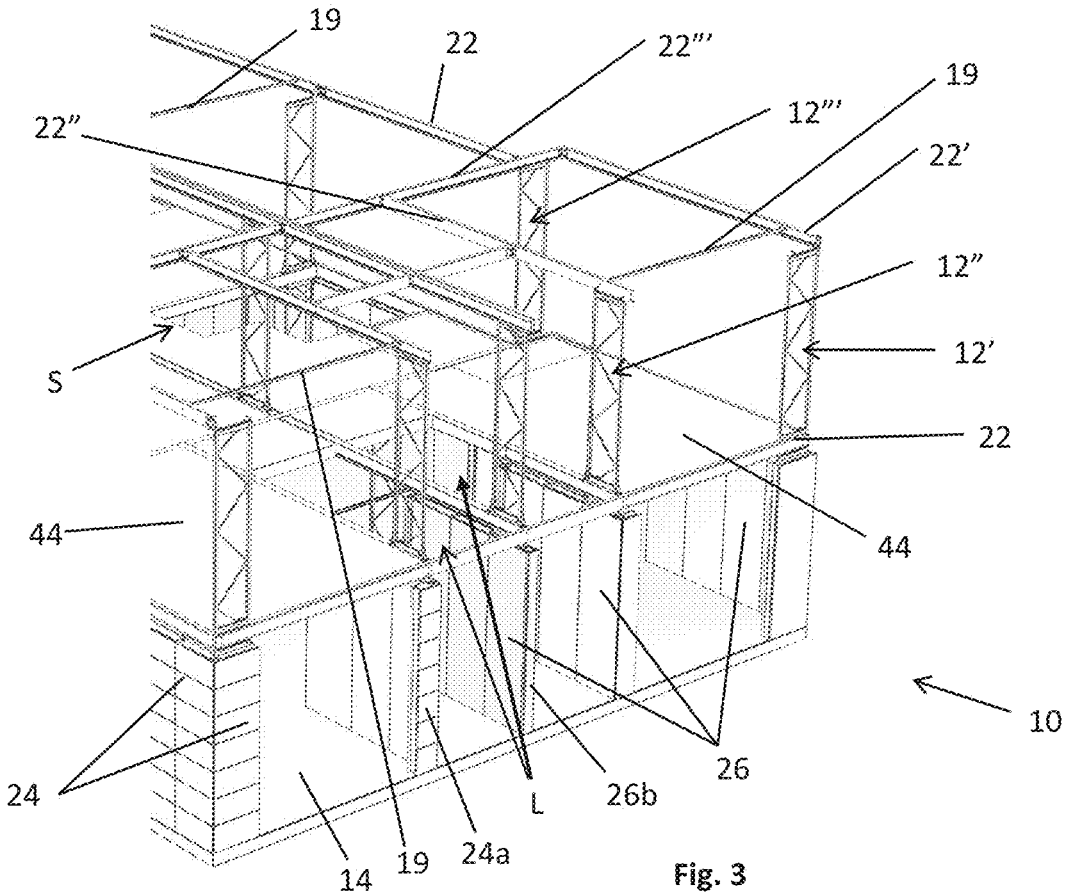
FIG. 3 shows a portion of a load bearing system for a partially assembled multi-storey residential structure.

In this regard, and referring to FIG. 3, internal cladding 26 can be mounted with respect to a back or internal face of each of the perimeter truss columns 12. The internal cladding can also be mounted with respect to a side face (e.g. one or both side edges) of each truss column 12. Further, for an intermediate truss column 12, the internal cladding 26 can be mounted with respect to front and back faces of the column. Whilst the internal cladding 26 can be directly mounted (e.g. screwed or adhered) to the truss columns 12, as above, typically the internal cladding is indirectly mounted to the truss columns via spaced elongate battens that are secured to span between adjacent truss columns.

As previously mentioned, the internal cladding 26 can be a type of cement panel such as an autoclaved aerated concrete (AAC) panel, a fibre-cement panel, etc. The internal cladding may instead comprise plasterboard, timber, or other suitable internal cladding material. Various combinations of the aforesaid materials may be employed. Typically, a number of such panels/materials are secured with respect to the truss columns 12 such as via the elongate battens (e.g. the horizontally-extending perforated top hat sections). Internal cladding panels can be secured to such battens via suitable fasteners (e.g. self-tapping screws, adhesive, etc.). In this way, external (perimeter) walls of the residential structure 10 comprise the externally mounted façade panels 26 and panels of the internally mounted internal cladding 26, with the truss column(s) sandwiched therebetween. Further, internal walls of the residential structure 10 comprise panels of internal cladding 26 located with respect to opposing front back (and optionally side edge(s)) of the truss column (s) sandwiched therebetween. In each such case, typically each truss column 12 becomes incorporated and hidden into the wall, as shown in FIG. 3.

FIG. 3 also illustrates a somewhat completed lower storey of the residential structure 10, with the overlying upper storey being shown in a partial stage of completion. In this regard, at the lower storey, internal cladding 26 is mounted to extend between the foundation 14 and beams 22 that extend internally of the residential structure. Floor material 44 (e.g. floor panels and/or floorboards) for the upper storey is mounted (e.g. affixed by fasteners) to span between the beams 22 that define a periphery of each room of the upper storey. FIG. 3 shows that some rooms and areas are left uncovered by floor material, where these spaces can define stairwells S, light-wells L, etc.

In the upper storey of FIG. 3, again it will be seen that at least some of the beams 22 can be mounted to the truss columns 12 at locations spaced away from the ends of the beams. For example, each of truss columns 12', 12" and 12''' connect to beams 22', 22" and 22''' in different configurations with respect to the upper ends of the truss columns. In one such configuration, an end of beam 22' connects to an end of beam 22''' to form a corner, whereby truss column 12''' is connected to beam 22''' away from the corner (i.e. at a location spaced from the ends of the beams). In another such configuration, truss column 12" is connected parallel to the beam 22" and proximal to an end thereof. In a further such configuration, truss column 12' is connected perpendicular to the beam 22' and proximal to an end thereof.

FIG. 3 also shows roof ties 19 that are provided to extend between two beams 22 (e.g. beams 22" and 22') at a front side, and optionally at intermediate and rear locations, of the upper storey of the residential structure 10. Each tie 19 can replace a corresponding beam 19 and can thereby complete the ring-like structure. As a result of replacing one of the beams, the remaining beams 22', 22" and 22''' define a U-type formation that provides the main structural support for an overlying roof or further storey. Whilst the ties 19 are slender in comparison to the beams 22, the ties can help tie together and stabilise opposing walls of the residential structure. Further, the ties 19 can be set back from a front edge of the residential structure as shown. This can allow, for example, a floor-to-ceiling window to be located in each of these front rooms (see FIGS. 16A and 16B). Likewise, the ties 19 can replace the rearmost beams of the back rooms (see FIG. 15) and can again be set back for floor-to-ceiling windows.

One side (e.g. of the perimeter) of the residential structure may comprise a long, single beam 22. Alternatively, a plurality of beams 22 can be arranged end-to-end to define the one or more sides. Typically, at least for the roof/floor located above the lower storey, the beams 22 are arranged to define a closed perimeter (i.e. a ring-like, polygonal beam arrangement) at the upper ends of the truss columns 12. This ring-like structure is such as to tie together the upper ends of the truss columns 12 and to support the upper storey on the lower storey. However, at certain locations in the roof-beam structure of the upper storey, certain of the beams can be replaced by ties 19, as set forth above.

As set forth above, FIGS. 2 and 3 show façade panels 24 being mounted to extend between the foundation 14 and the beams 22. The façade panels 24 are arranged around the perimeter of the foundation. In FIG. 3, some of the façade panels (e.g. 24*a*) are configured with a narrow form (e.g. panel 24*a* may be located between two floor-to-ceiling windows). Further, some of the façade panels may be omitted (e.g. at 26*b*) and replaced with a different facing material (e.g. to provide a different aesthetic and/or functional role). The facing material at 26*b* may sit behind e.g. a glass/window façade and may comprise e.g. internal cladding.

Depending on the design (e.g. to provide an 'industrial-type' aesthetic to the residential structure) internal cladding can be omitted at certain locations within the residential structure to expose or reveal the truss columns 12. In this form, the façade panels 24 continue to provide an external barrier to the residential structure, but at least some of the truss columns are exposed in the interior of the residential structure.

Figure 4:
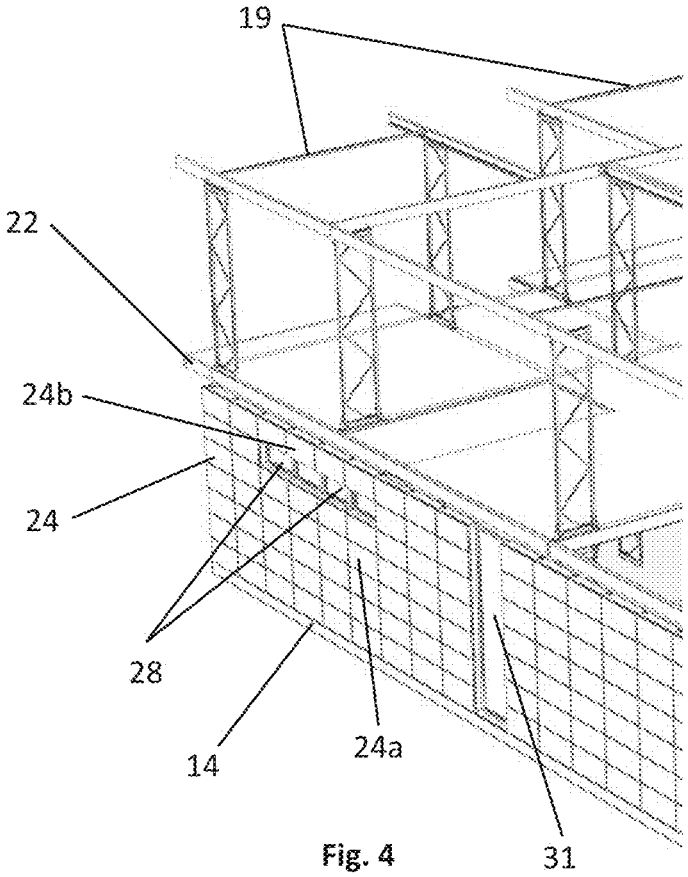
FIG. 4 shows a portion of a load bearing system for a partially assembled multi-storey residential structure.

As shown in FIGS. 2 & 4, fittings, such as windows 28, can be incorporated into the walls of the residential structure. Other fittings can be provided, in addition to the windows, which can include, e.g. doorways, ducts, vents, etc. Examples of such fittings are shown in FIGS. 16A and 16B.

In one form, the windows 28, etc. can be built into certain portions of the façade panels 24 (i.e. a prefabricated façade panel can be supplied to site that already incorporates a window, door, etc.). In another form, the windows 28, etc. can be separately sourced and supplied, and then arranged and mounted between two individual portions of façade panel. For example, a first portion 24*a* of the façade panel can be arranged below the window 28 to extend from the foundation 14 to a lower edge of the window. A second portion 24*b* of the façade panel can be arranged above the window to extend from an upper edge of the window to the beam 22.

In some forms, a window can be sized to extend the full height of a wall. This can take the form of a curtain window 31 that extends between the foundation 14 and the beam 22. For example, a façade panel 24 can be entirely substituted by curtain window 31. Similarly, a doorway can be provided in the system whereby a frame of the doorway substitutes for a façade panel 24 and substantially extends from the foundation 14 to the beam 22. Examples are shown in FIGS. 16A and 16B.

In some forms, at least some of the façade panels 24 can be entirely replaced with a curtain wall. For example, two or more adjacent façade panels can be substituted with the curtain wall. In this form, the curtain wall can be considered as a long (wide) external cladding panel.

Figure 5:
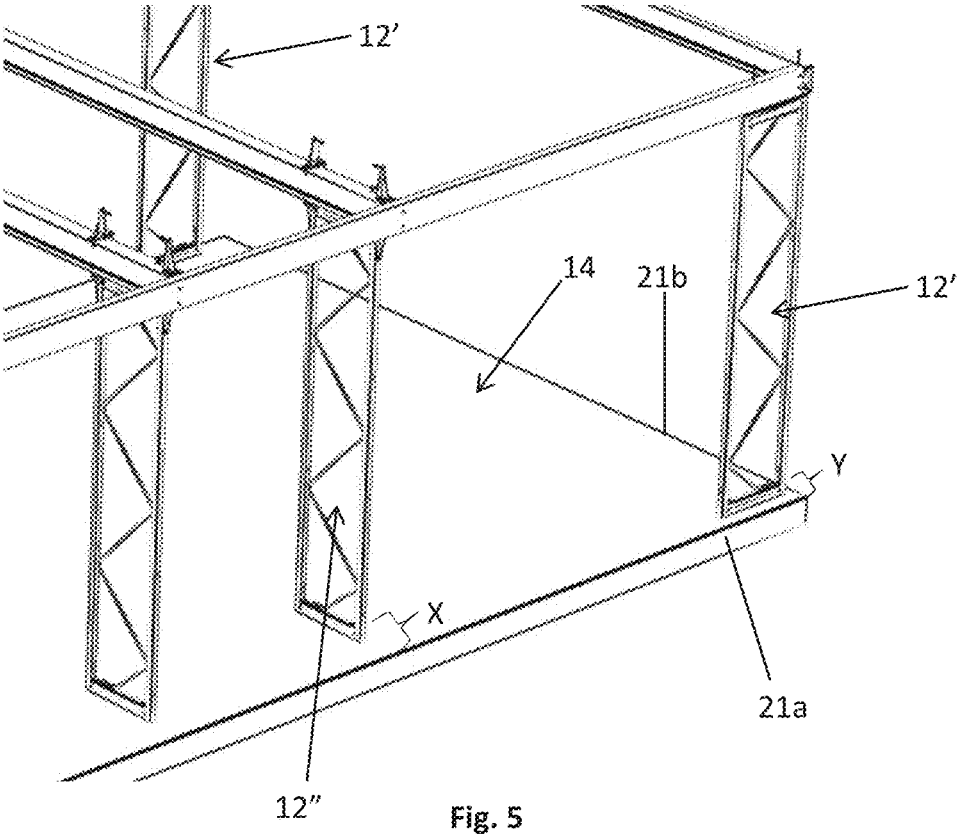
FIG. 5 shows a portion of a load bearing system for a ground level of a residential structure.

Referring now to FIG. 5, it will be seen that some of the truss columns 12' of the residential structure 10 are mounted to foundation 14 such that a front face thereof is parallel to an adjacent edge 21 of the foundation. Additionally, some of the truss columns 12" are mounted to foundation 14 such that a front (and back) face thereof is perpendicular to an edge 21 of the foundation. For example, the front truss column 12' of FIG. 5 is arranged at a corner of the foundation 14, whereby a front face of the column is parallel to a first edge 21*a* of the foundation but is perpendicular to a second edge 21*b* of the foundation.

As set forth above, perimeter truss columns 12 are typically also inset (i.e. spaced) from adjacent edge(s) of the foundation, as shown by truss columns 12' and 12" in FIG. 5. In particular, a front face of front truss column 12' is parallel to and inset from edge 21*a* of foundation 14 by a distance 'Y'. A front face of truss column 12" is perpendicular to edge 21*a*, with a side face of truss column 12" being inset from the edge of the foundation by a distance 'X'. Distance Y may equal distance X. Alternatively, distance X may be slightly greater than distance Y to account for the thickness of internal cladding that may be mounted to the side face of truss column 12". In each case, the inset spacing of truss columns 12 from the adjacent edge 21 of foundation 14 allows façade panels 24 to be mounted to the residential structure to be flush with the foundation edge.

Figure 6:
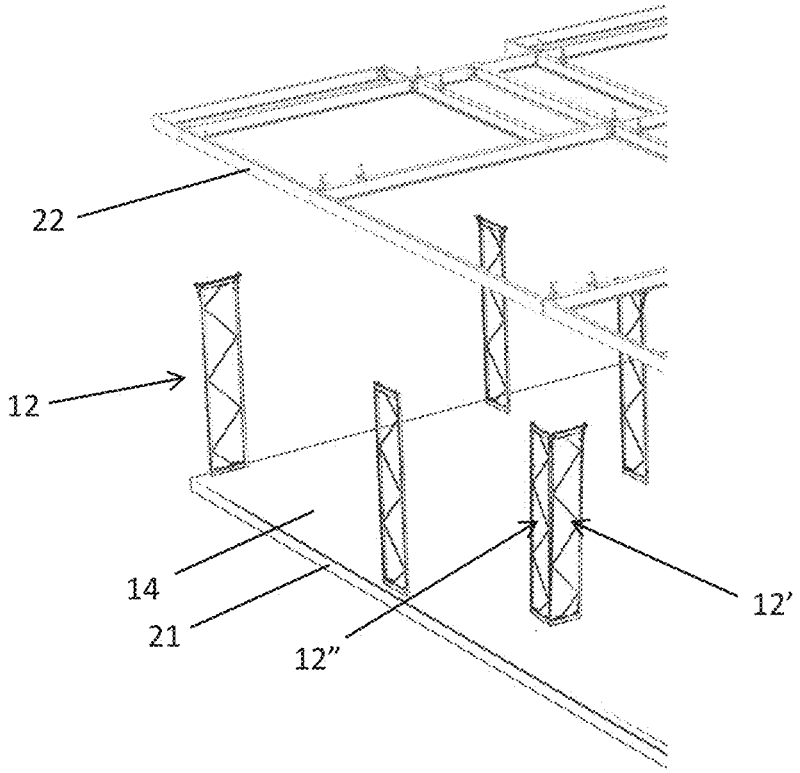
FIG. 6 shows a portion of a load bearing system for a ground level of a residential structure.

FIG. 6 illustrates an arrangement wherein at least some of the truss columns 12 are mounted at foundation 14 such that a front (and rear) face of a first truss column 12' is perpendicular to a front (and rear) face of an adjacent truss column 12". The perpendicular truss column pairs 12', 12" are typically located intermediate of (i.e. spaced well away from) edges 21 of the foundation 14, however, may also be employed at e.g. corners of the residential structure 10. The truss column pairs 12', 12" can instead have aligned front/back faces (see FIGS. 10, 10A, 20A and 20B), or their front/back faces can extend at (acute/obtuse) angles other than 90°. The truss column pairs 12', 12" can provide for increased load-bearing at their specific location within the residential structure. The truss column pairs 12', 12" can be arranged 'square' with corresponding edges of the foundation (i.e. front/back column faces are parallel or perpendicular to the foundation edges). Alternatively (e.g. for a different effect), the truss column pairs 12', 12" can be arranged 'offset' with corresponding edges of the foundation (i.e. front/back column faces are angled acutely/obtusely to the foundation edges).

FIGS. 9A to 9E illustrate in detail how the façade panels 24, internal cladding 26, fascia panels, etc. are secured with respect to the truss columns 12 and beams 22. These Figures show the connections employed where the residential structure comprises a lower (underlying) storey 46 and an upper (overlying) storey 48. Where the residential structure is a single storey, the connections to enable mounting of a roof structure are modified accordingly. This is illustrated in further detail below with reference to FIG. 9F.

Figure 9A:
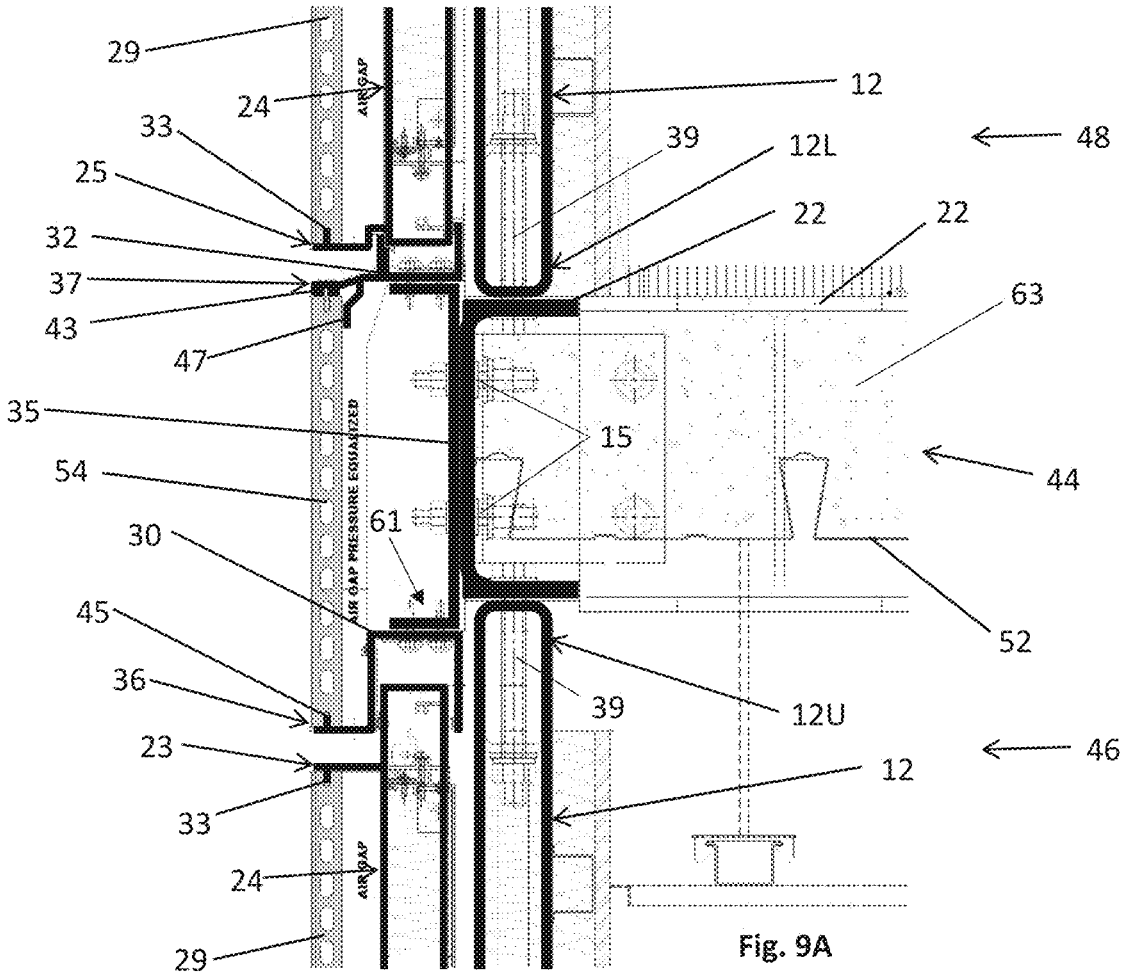
FIGS. 9A to 9G show a sectional view through a load bearing system for a residential structure, whereby FIGS. 9B and 9C each show detailed views of a sub-sill and sub-head, respectively.

FIG. 9A shows in more detail how each façade panel 24 comprises an external surface finish structure 29 that is mounted to face outwardly of the façade panel in use. To secure the external structure 29 to each façade panel 24, the panel comprises upper 23 and lower 25 retention formations that project laterally outwards therefrom. In this regard, the upper retention formation 23 projects laterally from an in-use upper end edge of the façade panel 24 and the lower retention formation 25 projects laterally outwards from an in-use lower end edge of the façade panel 24.

The external support 29 is secured to the façade panel 24 between the upper 23 and lower 25 retention formations. Typically, each façade panel 24 is prefabricated with the external support 29. Further, whilst external support 29 could be retained at the retention formations 23, 25 via e.g. screws, clips, adhesive, etc., in the embodiment of FIG. 9A, the upper 23 and lower 25 retention formations are each configured with an upstanding male mating feature 33 that can be received in a corresponding groove of the external support 29 (e.g. by sliding the support 29 into place from an end of panel 24 and then fixing it in place). This arrangement securely retains the external support 29 at the façade panel 24.

The external support 29 can have a variety of surface finishes applied thereto. For example, a cementitious material, such as a stucco, can be applied to render the external support 29. In other forms, the surface finish at the external support 29 can take the form of metal-, timber-, or stone-like sheets panels. As above, these surface finishes may be prefabricated or applied on site (e.g. after the façade panels 24 have been installed).

FIG. 9A also shows the connections of the façade panels 24 to each of the lower 46 and upper 48 storeys at the location of a floor 44 of the overlying storey. In this regard, a lower end region 12L of each truss column 12 of the upper storey 48 is mounted (i.e. bolted 39) to an upper flange of C-channel beam 22 that also supports the floor 44. The lower flange of C-channel beam 22 is likewise mounted (i.e. bolted 39) to an upper end 12U of truss column 12 of the lower storey 46. As shown the truss column 12 of the upper storey 48 is aligned with the truss column 12 of the lower storey 46. This provides a defined load path, down and through to the foundation 14.

Also mounted (i.e. bolted 15) to a web of C-channel beam 22 is the web of a fascia (C-channel) beam 35. The beams 35, 22 are mounted 'back-to-back', such that webs of the respective beams locate immediately adjacent to each other. As explained in more detail below, mounting of the fascia beam 35 to the C-channel beam 22 enables a fascia panel 54 to be mounted externally of the fascia beam 35. The fascia panel 54 covers a join between the lower 46 and upper 48 storeys at the location of floor 44. The fascia panel 54 can also effectively provide a continuous externally clad wall in that it aligns with and spans between the external supports 29 of the lower and upper façade panels 24. The fascia panel 54 can also have the same (or a different—e.g. complementary) surface finish to that employed at the external supports 29.

Figure 9B:
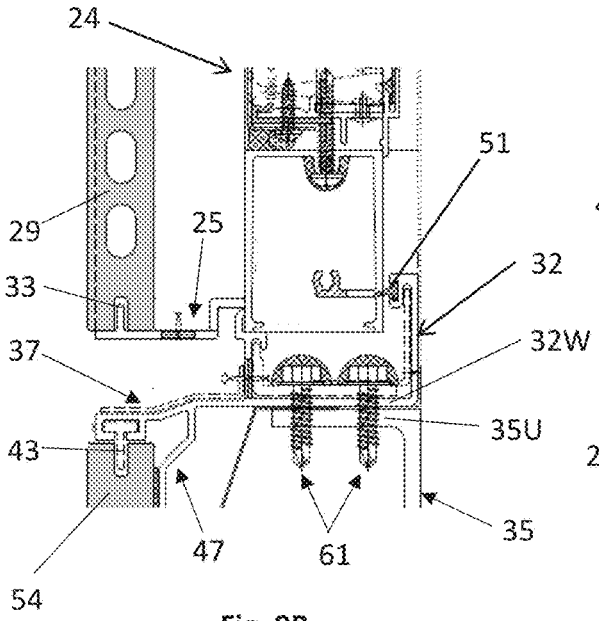
Figure 9C:
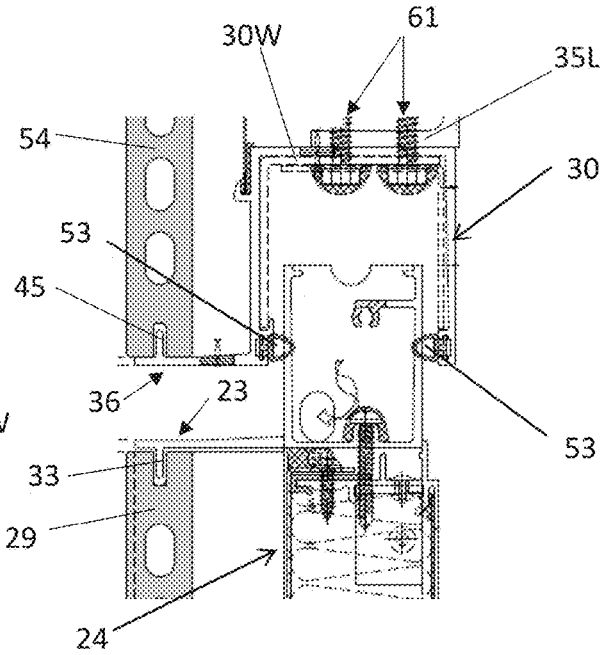
Figure 9D:
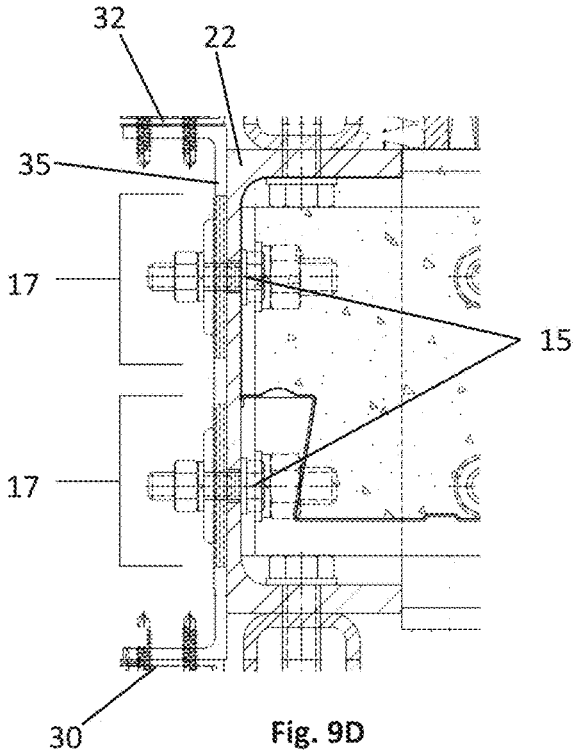
Figure 9E:
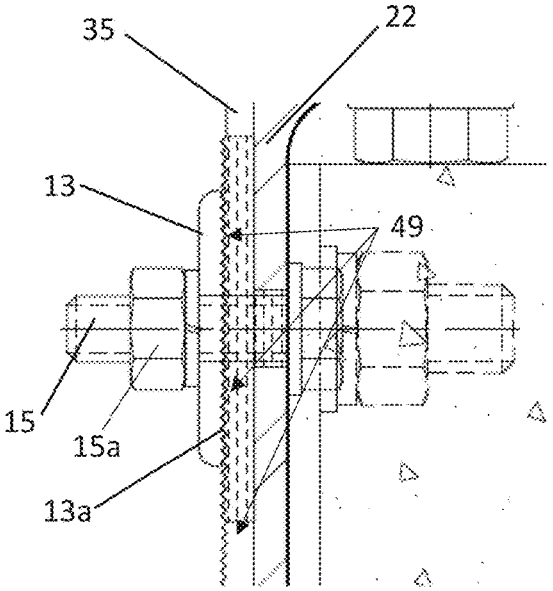
Figure 9F:
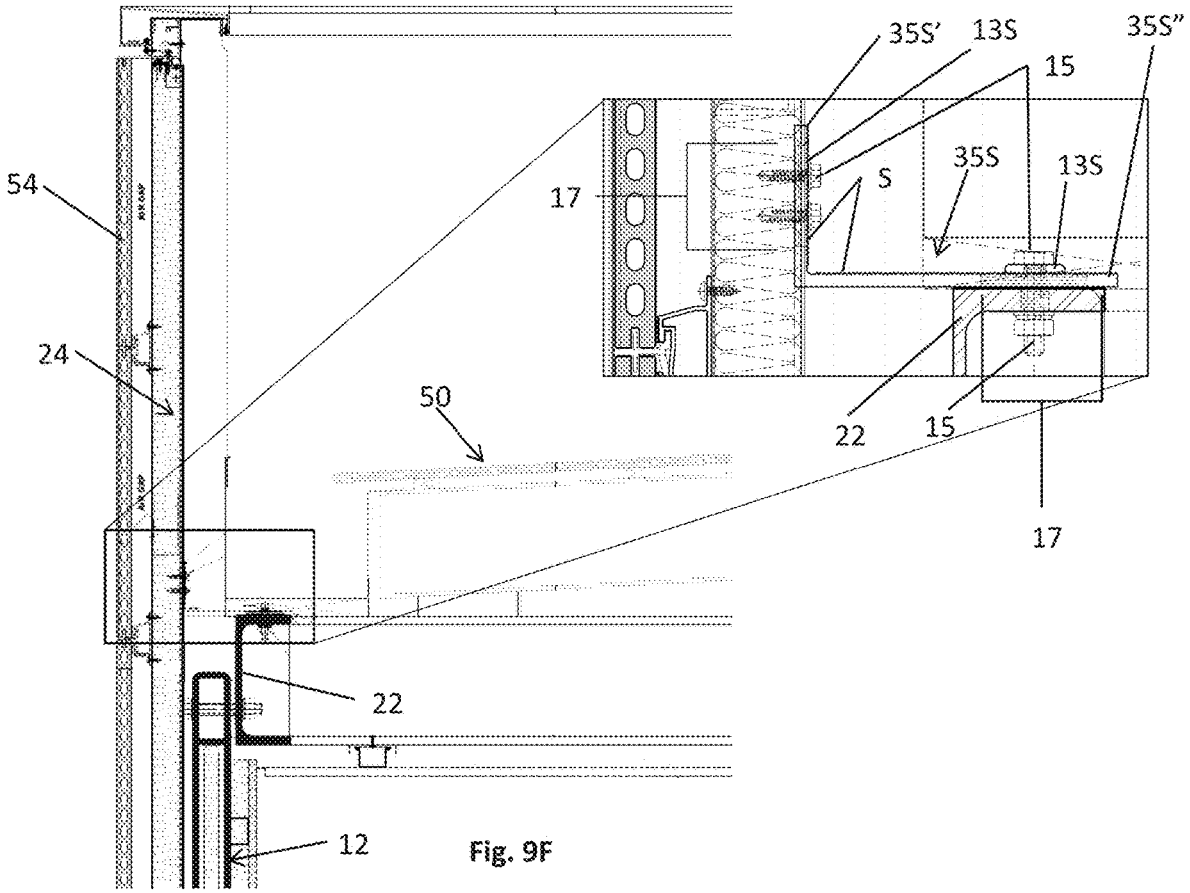

For a roof 50 of either a single-storey or a multi-storey residential structure, the fascia beam 35 takes the form of an extruded L-bracket 35S mounted (e.g. bolted 15) to a web of C-channel beam 22 as illustrated in FIG. 9F. The beam 22 and L-bracket 35S are mounted flange-to-flange, i.e. such that a flange of the respective beam and L-bracket locate immediately adjacent to each other.

At the roof of the residential structure, flanges 35S', 35S" of the L-bracket 35S can support façade panels 24 by mounting between the panels 24 and beams 22 of the residential structure. In this way, a first flange 35S' is arranged to mount at a panel 24 and a second flange 35S" is arranged to mount at the beam 22. The upper flange of the beam 22 can also support a mounting arrangement for a roof 50 of the single storey residential structure.

Figure 9G:
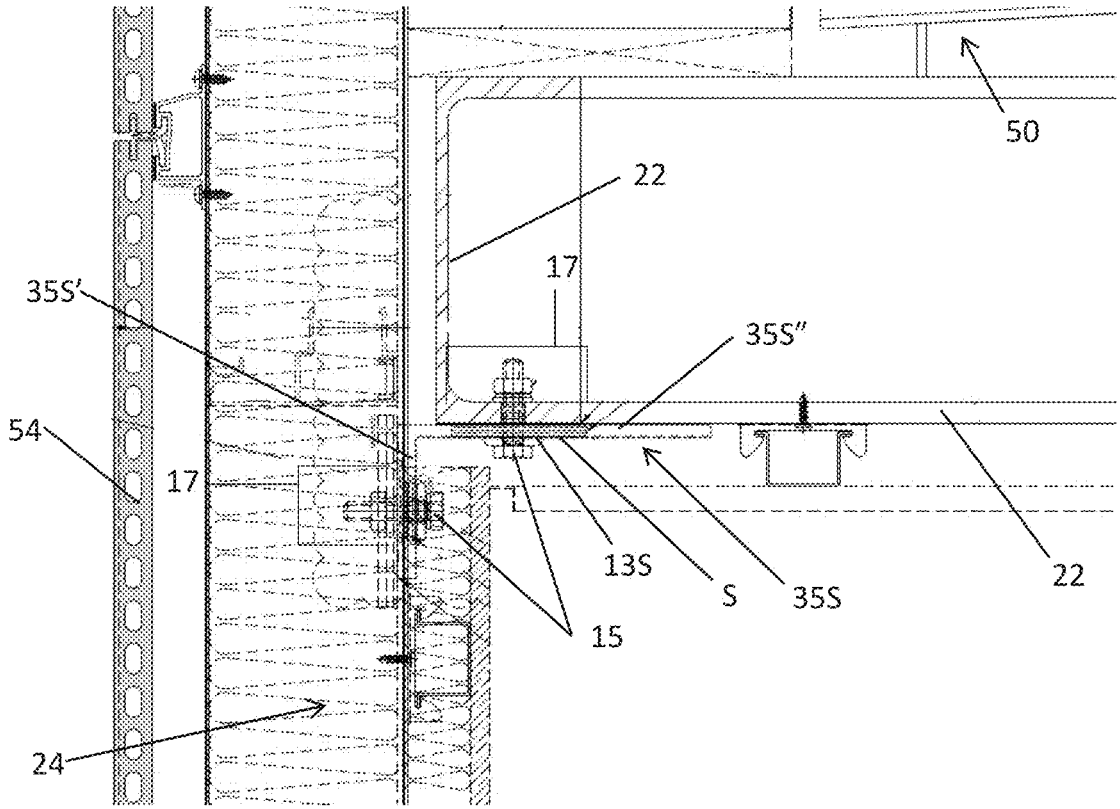
Figure 9H:
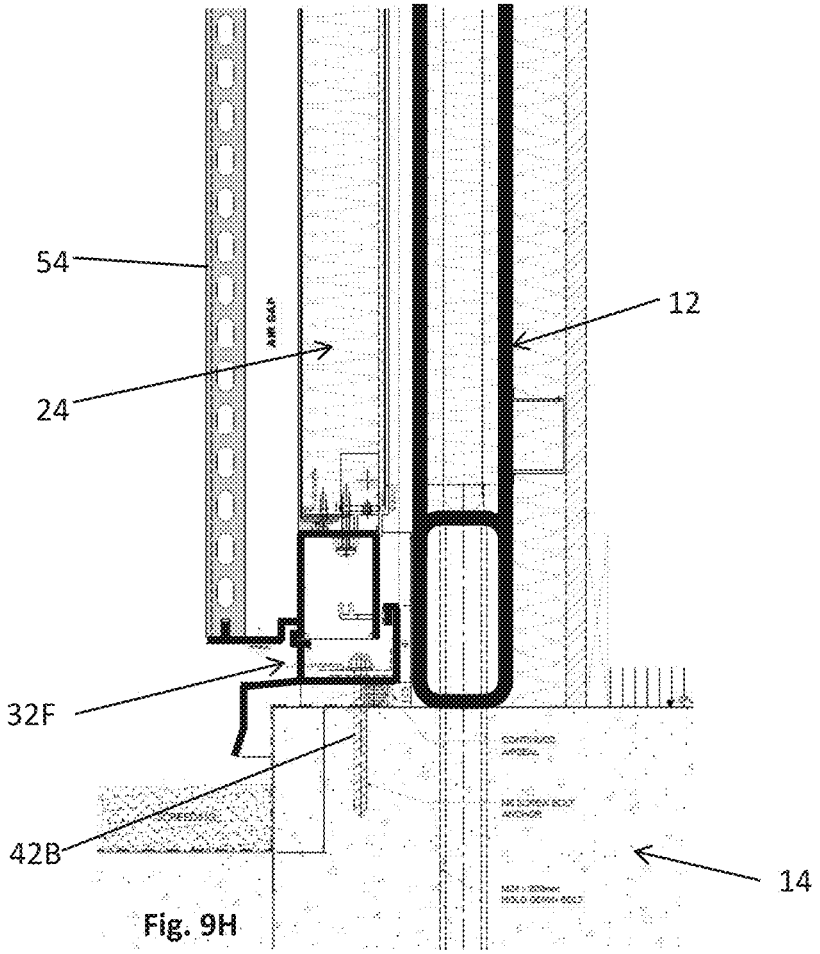
FIG. 9H shows a detailed view of a beam and a sub-sill at a foundation of the residential structure.

A sub-sill 32F for receiving and supporting a lower edge of the façade panels 24 is mounted (e.g. bolted at 42B) to the foundation 14 of the residential structure 10. These arrangements are shown in further detail in FIGS. 9F and 9H.

Advantageously, for a multi-storey residential structure, a lower flange of the fascia beam 35 can again support a sub-head 30 for mounting of the lower storey façade panels 24 to the residential structure. In addition, the upper flange of the fascia beam 35 can support a sub-sill 32 for mounting of the upper storey façade panels 24 to the residential structure.

Figure 15:
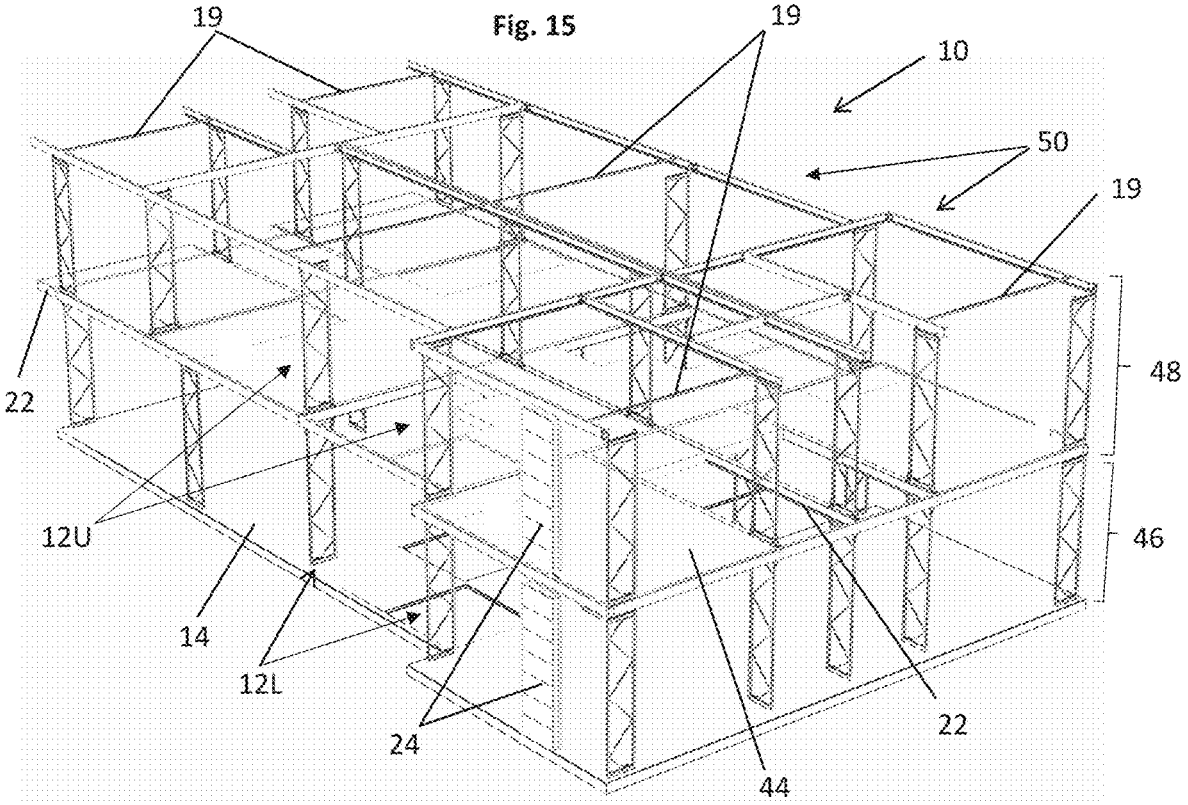
FIG. 15 shows perspective view of a load bearing system for a partially assembled multi-storey residential structure.

FIG. 9A also illustrates a floor formwork structure 52 for formation of the floor 44 (also shown in FIG. 15). The floor formwork 52 is shown mounted (e.g. spot-welded, riveted, etc.) to an inside face of the web of beam 22, and can extend between the beams that form a perimeter of each room. The floor formwork 52 typically takes the form of decking which is configured to provide a mould for cementitious material (such as concrete 63) to be poured therein to form the floor 44 of the overlying storey.

Instead of decking, a framework-type floor support structure can be provided and mounted with respect to, and to extend between, the beams that form a perimeter of each room. The framework-type floor structure can be configured for the mounting thereto of floorboards, panels, etc. to form the floor of the overlying storey. For example, a flooring system that comprises e.g. AAC or fibre-cement panels can be installed.

As best shown in the detailed view of FIG. 9D, the web of fascia beam 35 has in-use vertically elongate apertures 17 formed therethrough (i.e. extending perpendicular to a length of the beam). The apertures 17 are spaced out along the length of the fascia beam 35 to facilitate its height-adjustable mounting to the beam 22. In this regard, the bolts 15 are extended through the apertures 17 in the web of fascia beam 35 and through corresponding apertures in the web of beam 22. The apertures 17 allow the height/level of fascia beam 35 to be adjusted in relation to the bolts 15, and with respect to the beam 22. In this regard, during mounting, the fascia beam 35 can be adjusted up or down, so that it is suitably positioned for the underlying and overlying façade panels 24. Also, the length of the fascia beam can be arranged level (e.g. with the foundation 14 and the floor 44) to be horizontal. Further, when the fascia panel 54 is being mounted between the façade panels 24, it can be suitably aligned with them by virtue of such adjustment. Such adjustment of the fascia beam 35 can also accommodate for any minor deviations in the positioning of beam 22, or of the bolt-receiving apertures in beam 22, that might otherwise cause the fascia beam to not be horizontal when mounted.

Similarly, the fascia beam in the form of the L-bracket 35S mounted to a flange of C-channel beam 22 can have elongate apertures 17 formed therethrough. As best shown in FIG. 9F, the apertures 17 are arranged to extend perpendicular to a length of the beam and are spaced out along the length of the second flange 35S" of the L-bracket 35S to facilitate its adjustable mounting with respect to the beam 22. Furthermore, apertures 17 are similarly arranged along the length of the first flange 35S' of the L-bracket 35S to facilitate adjustable mounting of the cladding (façade) panel 24 with respect to the L-bracket 35S.

Firstly, considering the adjustable mounting of the L-bracket with respect to the beam 22, the bolts 15 are extended through the apertures 17 in the second flange 35S" and through corresponding apertures in the flange of beam 22. The arrangement of the apertures 17 allow the L-bracket 35S to be horizontally adjusted with respect to the beam 22. In this regard, the position of the L-bracket 35S can be adjusted such that the first flange 35S' is spaced closer to, or further from the beam 22. This can allow the L-bracket to be suitably positioned such that façade panels 24 attached thereto are orientated e.g. plumb. Such adjustment of the L-bracket 35S can also accommodate for any minor deviations in the positioning of beam 22, or of the bolt-receiving apertures in beam 22, that might otherwise cause the façade panels 24 to misaligned (e.g. not be plumb) when mounted to the structure.

Secondly, considering the adjustable mounting of the façade panels 24 with respect to the L-bracket, the bolts 15 (or screws) are extended through the apertures 17 in the first flange 35S' and through a façade panel 24. In some methodologies, the bolts/screws can be loosely fit, i.e. partially bolted/screwed into the panel such that the panel is loosely held against the first flange 35S'. In this way, the apertures 17 in the flange 35S' allow the upper end of the facade panel 24 to be vertically adjusted with respect to the beam 22. In this regard, the position of the façade panel 24 can be adjusted such that its upper end can be spaced closer to, or further from the beam 22. Such adjustment of the façade panel's vertical position can accommodate for any minor deviations in the positioning of beam 22 or sub-sill 32 that might otherwise cause an array of façade panels across the length of the residential structure to be misaligned.

As shown in FIG. 9F, the L-bracket is configured such that when the second flange 35S" is mounted to beam 22, the first flange 35S' extends outward from an internal space defined by the perimeter of the residential structure. The second flange 35S" has a length (in profile) such that the first flange 35S' extends outward beyond the columns 12 spaced between the cladding (façade) panels 24 and the beams 22.

In some forms (described previously) whereby a beam 22 extends between two columns 24, cladding panels 24 can be mounted to extend between the beam 22 and the foundation 14 whereby there are no columns spaced between the cladding panel 24 and the beam 22. In this form, (and referring to FIG. 9G), the cladding panels 24 can be mounted to the beams 22 via an inverted L-bracket. The inverted L-bracket can be mounted between the panels 24 and beam 22 in the same way as the L-bracket (i.e. when not inverted) as set forth above.

As best shown in FIG. 9E, an inner surface portion 49 of the web of fascia beam 35 can be serrated. Typically, this serrated surface is adjacent to and surrounds the vertically elongate apertures 17. The serrated surface 49 can be engaged by a locking washer/plate 13 which is also serrated 13*a* at its underside—i.e. to mesh with the serrated web portion 49 of the fascia beam when bolt 15 is mounted thereat. The locking washer/plate 13 is retained in place by a respective nut 15*a* of each bolt 15. Having located the bolt 15 at the correct location, and once the nut 15*a* is driven home securely into its locking position (thereby compressing together the washer/plate 13 and webs of beams 35 and 22), the meshing of washer/plate serration 13*a* with the serrated web portion 49 secures each bolt 15 in position against vertical shifting forces (i.e. preventing each bolt from be shifted/shunted up or down in its respective elongate aperture 17 and thereby preventing the fascia beam 35 from moving vertically up or down in use).

Similarly, the intermediate beam in the form of the L-bracket 35S can have serrated surfaces S on each of the first 35S' and second 35S" flanges. The serrated surfaces on the second flange 35S" are configured for locking the L-bracket in position with respect to the beam 22. The serrated surfaces on the first flange 35S' are configured for locking a panel 24 with respect to the L-bracket. In each case, the serrated surfaces S can be engaged by a locking washer/plates 13S which are also serrated at their underside and positioned between bolts 15 and the respective flanges 35S' and 35S".

The locking washers/plates mesh with the serrated flange surfaces S when the bolts 15 are tensioned to engage the flanges 35S', 35S" at respective panel 24 and beam 22. The meshing of washer/plate serrations with the serrated surface of the second flange 35S" secures bolts 15 in position against horizontal shifting forces (i.e. preventing the bracket 35S and thus, panel 24, moving towards or away from an outside of the structure 10). The meshing of washer/plate serrations with the serrated surface of the first flange 35S' secures bolts 15 (or screws) in position against vertical shifting forces (i.e. preventing the panel 24 sliding up or down from its optimal position).

In some forms, locking washers/plates positioned between the bolts 15 (or screws) and the first flange 35S' can be excluded, or inverted, such that the bolt 15 (or screws) are not mounted in a locked position with respect to the flange 35S. In this form, the panel 24 (when mounted to the flange 35S via the bolts 15 (or screws)) can freely move (upwards or downwards) with respect to the elongate apertures 17. Advantageously, this can allow the panels 24 to be secured in position at the L-bracket (and respective beam), and then be adjusted in position (within the range allowed by the length of the elongate aperture 17). This can allow the panel 24 to be aligned with adjoining panels.

Referring now to FIGS. 9A to 9C, it will be seen that the façade panels 24 for the lower storey 46 are each mounted with respect to beam 22 via sub-head 30. In this regard, as best shown in FIG. 9C, a web 30W of the sub-head 30 is mounted (e.g. screwed, riveted, etc.), such as via self-tapping screws 61, to the underside of a lower flange 35L of fascia beam 35. Typically, the sub-head 30 for the lower storey façade panel 24 is secured into place on fascia beam 35 once the lower storey façade panel 24 has been lifted into a suitable position and secured at the foundation 14 of the residential structure. Once the upper side region of each lower storey façade panel 24 is located within the securely mounted sub-head 30, each façade panel 24 becomes laterally and vertically supported at the residential structure 10.

FIG. 9C also shows that the sub-head 30 is configured to provide a sealed interface between laterally adjacent surfaces of the sub-head and the upper side region of the lower storey façade panel 24 (i.e. when located therein). This can serve to weatherproof the exterior of the residential structure 10 (e.g. against water ingress). In this regard, the sealing interface is provided by opposing sealing strips 53 located to project inwardly from and extending along opposing side walls of the sub-head 30 so as to contact the front and back faces of the façade panel 24 along its upper side region. When the sub-head 30 is arranged over, so as to receive therein, the upper side region of the façade panel 24, the opposing sealing strips 53 deform and seal against the front and back faces of the façade panel 24. In place of or in addition to the sealing strips 53, a deformable sealant can be injected into the cavity defined between the sub-head 30 and façade panel 24. The sealing strips 53 can be of a suitable rubber, elastomer, polymer, etc.

FIGS. 9A and 9B illustrate sub-sill 32 for the façade panels 24 of the upper storey 48. The sub-sill 32 is again mounted with respect to beam 22 to thereby enable the upper storey façade panels 24 to be mounted with respect to the beam 22. In this regard, and as best shown in FIG. 9B, a web 32W of the sub-sill 32 is mounted (e.g. screwed, riveted, etc.), such as via self-tapping screws 61, to the upper side of an upper flange 35U of fascia beam 35. Typically, the sub-sill 32 for the upper storey façade panel 24 is secured into place on fascia beam 35 before the upper storey façade panel 24 is lifted into location, with the lower side region of each upper storey façade panel 24 being located within the already securely mounted sub-sill 32. Again, the sub-sill 32 secures each upper storey façade panel 24 so that it is both laterally and vertically supported at the residential structure 10.

FIG. 9B also shows that the sub-sill 32 is configured to provide a sealed interface between laterally adjacent surfaces of the sub-sill and the lower side region of the upper storey façade panel 24 (i.e. when located therein). Again, this can serve to weatherproof the exterior of the residential structure 10 (e.g. against water ingress). In the arrangement shown in FIG. 9B, the sealing interface is provided by a single flexible/deformable sealing strip 51 located to project inwardly from and extending along an inner side wall of the sub-sill 32 so as to contact the back face of the façade panel 24 along its lower side region. When the sub-sill 32 receives therein the lower side region of upper storey façade panel 24, the sealing strip 51 is deformed and seals against the back face of the façade panel 24. In place of or in addition to the sealing strip 51, a deformable sealant can be injected into the cavity defined between the sub-sill 32 and façade panel 24. Again, the sealing strip 51 can be of a suitable rubber, elastomer, polymer, etc.

As set forth above, the sealing arrangements at each of the sub-head 30 and sub-sill 32 are designed to prevent water ingress from outside the residential structure. The sealing configurations are designed to comply to multiple Australian building standards. For example, the sealing configuration at each of the sub-head and sub-sill allows the system to conform with Australian Standard 2208 for Safety glazing materials in buildings and Australian Standard 1288 for Glass in buildings. Thus, a prefabricated system can be supplied that it already 'Standards-compliant'.

It should be noted that each façade panel 24 is mounted in the sub-head 30 and sub-sill 32 such that that the panel 24 is able to move independently thereof. In this way, minor movements of each panel 24 does not impact the load bearing structure. This independent movement can accommodate movement such as typical thermal expansion and contraction, flexing and lifting due to wind/rain loading, etc. The independent movement can also allow for movement in the wider load bearing structure (again, such as thermal expansion/contraction, flexing and lifting due to dynamic loading, etc.). The independent movement can minimise e.g. cracking, breaking, water and air ingress, etc in external and internal walling of the residential structure.

Referring again to FIGS. 9A to 9C, it will be seen that each of the sub-head 30 and sub-sill 32 further comprise respective retention formations 36 and 37 for retaining the fascia panel 54 with respect to the fascia beam 35 and to also align the fascia panel 54 with the external supports 29 of the lower and upper storey façade panels 24 (i.e. to complete the external façade of the residential structure). The fascia retention formation 36 projects laterally from the sub-head 30 in-use. Formation 36 comprises an upstanding male mating feature 45 that can be received in a corresponding groove at the lower edge of fascia panel 54 (e.g. by sliding the panel 54 into place from an end of the fascia beam 35, and then fixing it once in place).

The fascia retention formation 37 projects laterally from the sub-sill 32 in-use. Formation 37 is configured to retain a downwards extending male mating element 43 that can be received in a corresponding groove at the upper edge of fascia panel 54 (e.g. by sliding the panel 54 into place from an end of the fascia beam 35, and then fixing it once in place). Additionally, the fascia retention formation 37 also comprises a bracing support 47 for supporting an inside face of an upper edge of the fascia panel 54.

Instead of using male mating features 43, 45, the fascia panel 54 can be secured between the fascia retention formations 36, 37 via e.g. screws, clips, adhesive, etc. Further, the retention formations 25 of the cladding panels 24 can also comprise bracing formations similar to the formation 47 of sub-sill 32.

Referring now to FIGS. 10 and 10A, two truss columns 12 are shown coupled (i.e. mounted) together in a side-by-side relation, to support greater loads than a single column. It is envisaged that more than two truss columns can be coupled together according to the design requirements of the residential structure so as to support higher loads. For example, three side-by-side aligned truss columns 12, four truss columns 12 arranged in a square, etc. In the form shown in FIG. 10, the two truss columns are releasably connected together by e.g. bolted connections 34. In this form, and as shown in FIG. 7, apertures 69 are provided in the periphery, i.e. in the vertical members 56 of the column, for receiving the bolts 34 to mount the columns together in the side-by-side relation. Apertures 70 are also provided in respective upper and lower surfaces of the top and bottom chords 58; the top chord for bolting 39 to the beam 22, and the bottom chord for bolting 42 to the foundation 14. Additional apertures 72 are also provided in front and back faces of each of the top and bottom chords 58. These additional apertures can variously be employed, including for coupling brackets as will now be described.

In the form shown in FIG. 10A, the two truss columns can also each be coupled to the beam 22 via at least one respective gusset bracket 66. Connections between the truss column(s) and beams, and truss column(s) and floor will now be discussed in further detail.

Figure 14A:
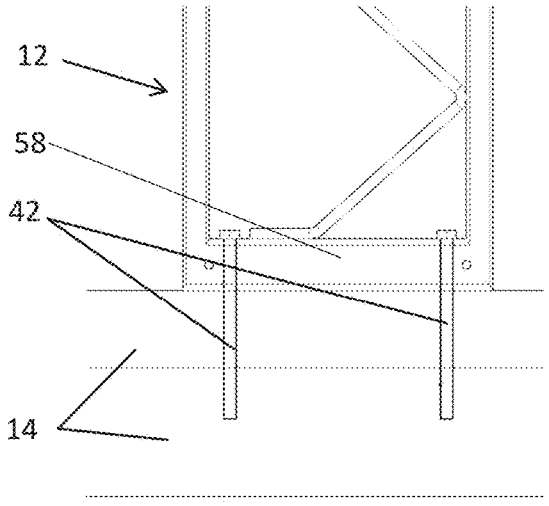

Single truss columns (FIG. 7) and double truss columns (FIG. 10) can each be connected to the foundation 14 by bolted connections 47 (see also FIG. 14A). The single and double truss columns can, in addition to bolts 39, each also be connected to the beams 22 via gusset brackets 66. As shown in FIG. 10A, each gusset bracket 66 is configured to make use of the apertures 72 provided in the front and back faces of the top chord 58—i.e. via a suitable bolt extending therethrough.

FIG. 10A also illustrates two beams 22' and 22" being bolted 76 together end-to-end. Additionally, FIG. 10A illustrates a truss column 12 of an upper (overlying) storey being connected (bolted 39) to the beam 22', also via opposing gussets 66. The upper storey truss column 12 is aligned with one truss column of the lower storey double truss column arrangement (although could be aligned so as to bridge the two lower storey truss columns).

Figure 11A:
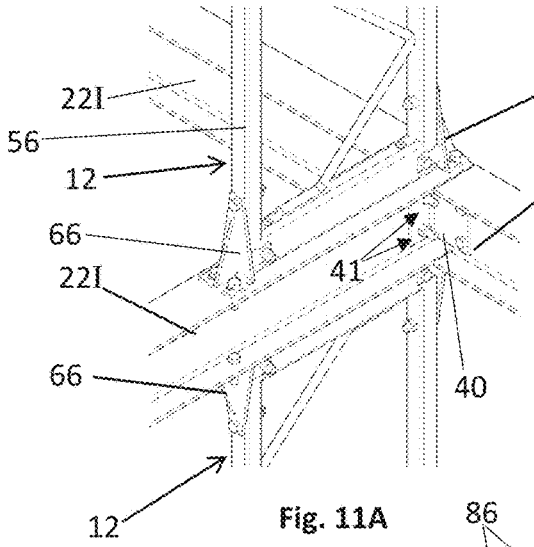
FIGS. 11A to 14B show various bracket and foundation mounting arrangements of the load bearing system for a residential structure.
Figure 11B:
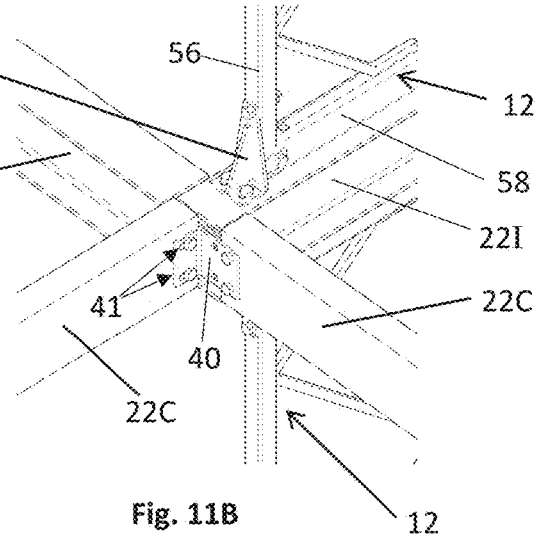
Figure 11C:
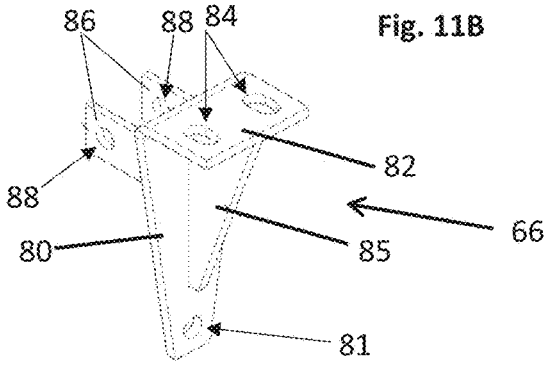

FIGS. 11A to 11C illustrate various ways in which single truss columns 12 can be mounted to the beams 22 via brackets 66. As illustrated in more detail in FIG. 11C, each bracket 66 comprises a main plate 80 which has a single bolt-receiving aperture 81 formed though one end. The main plate 80 is bent at an opposite end to define a beam-mount 82, which has two spaced bolt-receiving apertures 84 therethrough. A strengthening gusset 85 extends between the main plate 80 and beam-mount 82. Extending from a rear of the main plate 80 are two lugs 86, with each lug having a bolt-receiving aperture 88 therethrough. The beam mount 82 of each bracket 66 is bolted to the beam 22 as shown in each of FIGS. 11A and 11B. The lugs 86 are bolted to either side of either the bottom or top chord 58 of each upper or lower storey truss column 12, via the chord apertures 72. The main plate 80 is bolted to one of the vertical members 56 via its lower aperture 69. The connectors 66 are configured for supporting the truss columns 12 at the beams 22 in torsional loading.

In the arrangement of FIGS. 11A and 11B, some of the beams 22 take the form of I-beams 22I. Some of the beams are C-beams 22C. The brackets 66 can be connected to either beam type. The intersecting beams can be connected (e.g. bolted 41) together via an angle bracket 40. The angle bracket 40 is shown in greater detail in FIG. 13D and extends between and is bolted 41 to a respective web of each of the adjacent intersecting beams as shown.

Figure 12A:
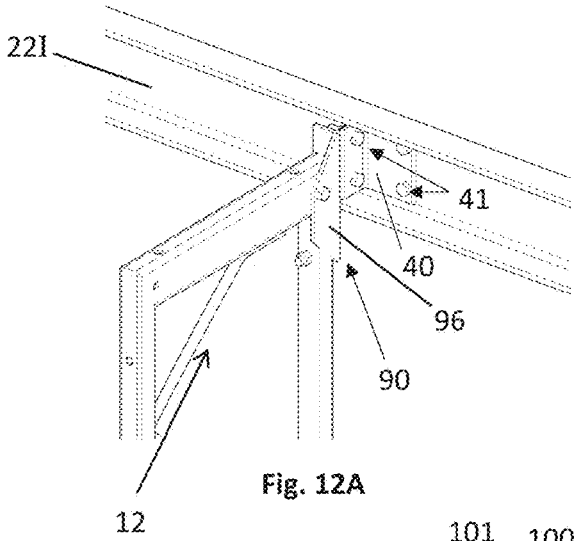

FIG. 12A illustrates a single truss column 12 being mounted (e.g. bolted 94) to the web of an I-beam 22I. The truss column 12 is mounted to I-beam 22I via a three-way bracket 90, shown in detail in FIG. 12C. The three-way bracket 90 comprises a main plate 96 having an offset aperture 97 therethrough. A lug 98 extends off in line with the main plate 96 and has two apertures 99 therethrough. A side plate 100 extends perpendicularly from the main plate 96 and has an offset aperture 101 therethrough. The main plate 96 is bolted to the truss column 12 via apertures 72. The side plate 100 is bolted to the truss column 12 via an upper side aperture 69. The lug 98 is bolted to an angle bracket 40 that is bolted 41 to the web of I-beam 22I.

Figure 12B:
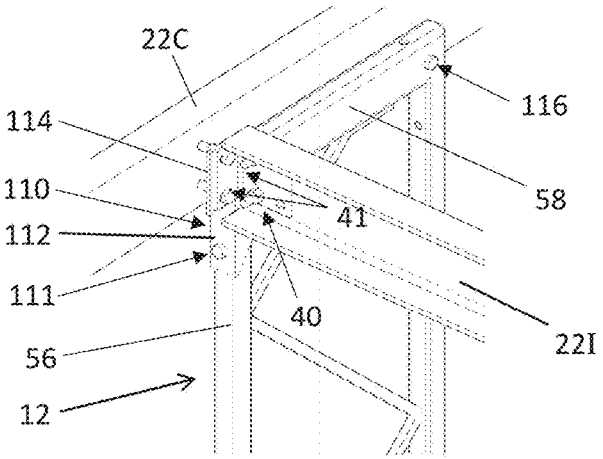
Figure 12C:
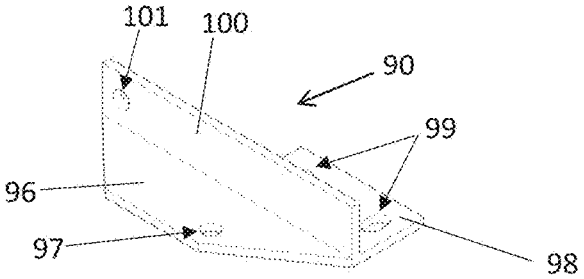

FIG. 12B illustrates a single truss column 12 being mounted (e.g. bolted) at the intersection of an I-beam 22I with a C-beam 22C. The truss column 12 is indirectly connected to the web of I-beam 22I and the web of C-beam 22C via a connector 110. In this regard, the connector 110 comprises a plate 112 that is mounted (e.g. bolted 111) to the truss column 12 via an upper side aperture 69 of the vertical member 56. A projection 114 that extends from plate 112 is connected to a back side of a flange of the angle bracket 40 via bolts 41. The truss column 12 also becomes indirectly mounted to the web of C-beam 22C via the projection 114, with the bolts 41 extending through and being bolted to the web of C-beam 22C. Thus, the projection 114 is sandwiched between the flange of angle bracket 40 and the web of C-beam 22C. An opposite side of the truss column 12 can be directly bolted to the web of C-beam 22C via a bolt 116 that extends through an aperture 72 of upper chord 58.

Figure 13A:
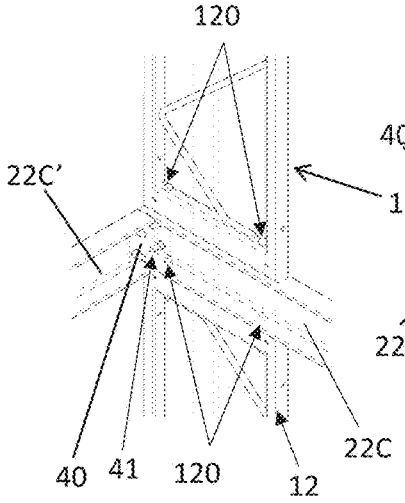
Figure 13B:
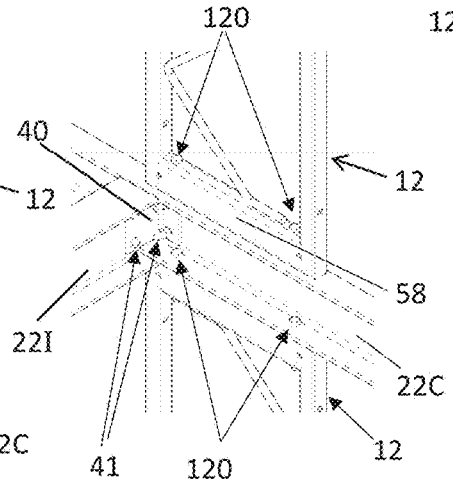
Figure 13C:
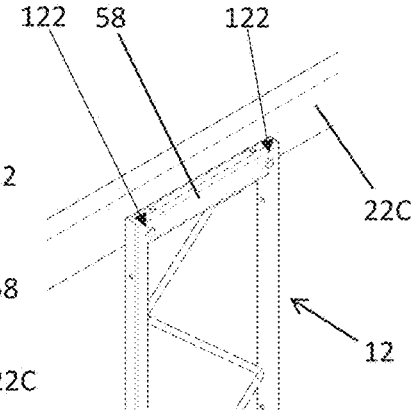

FIGS. 13A to 13C illustrate various alternative ways by which the truss columns 12 can be directly mounted to the beams 22. In FIG. 13A, upper and lower storey truss columns 12 are directly bolted 120 to respective upper and lower flanges of a C-beam 22C. The web of C-beam 22C is, in turn, connected to the web of an adjacent intersecting C-beam 22C' via bolts 41 extending through the angle bracket 40.

FIG. 13B shows essentially the same direct bolting 120 to upper and lower flanges of C-beam 22C as shown in FIG. 13A. However, in this arrangement, the web of C-beam 22C is connected to the web of an adjacent intersecting I-beam 22I via bolts 41 extending through the angle bracket 40.

In FIG. 13C, a truss column 12 is directly mounted via bolts 122 to a rear of the web of C-beam 22C. The bolts each extend through respective apertures 72 of upper chord 58

Figure 13D:
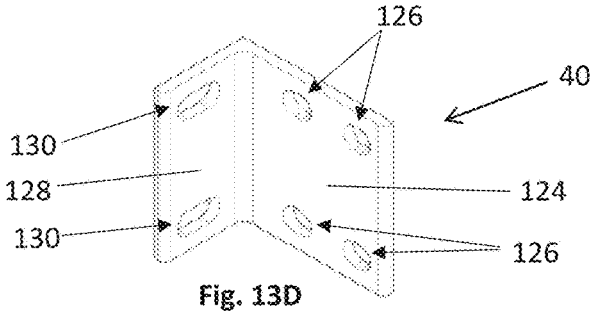

FIG. 13D shows the angle bracket 40 in more detail. The angle bracket 40 comprises a main flange 124 having four apertures 126 therethrough. The angle bracket 40 also comprises a secondary flange 128 extending orthogonally from the main bracket 124 and having two elongate apertures 130 therethrough. The elongate apertures 130 allow for adjustability of bolting in use.

FIG. 14A illustrates how a bottom chord 58 of each truss column 12 is typically mounted to the foundation 14 of the residential structure 10. In this regard, the truss column 12 can be releasably mounted to the foundation 14 by two spaced bolted connections 42. Typically, the elongate bolts 42 are high shear, robust and are mechanically and/or chemically anchored to the foundation 14. The bolts 42 extend through the aligned holes 70 provided in bottom chord 58 of each truss column 12. Each truss column 12 can be mounted to the foundation with more than two bolts and/or using one or two gusset brackets 66.

Figure 14B:
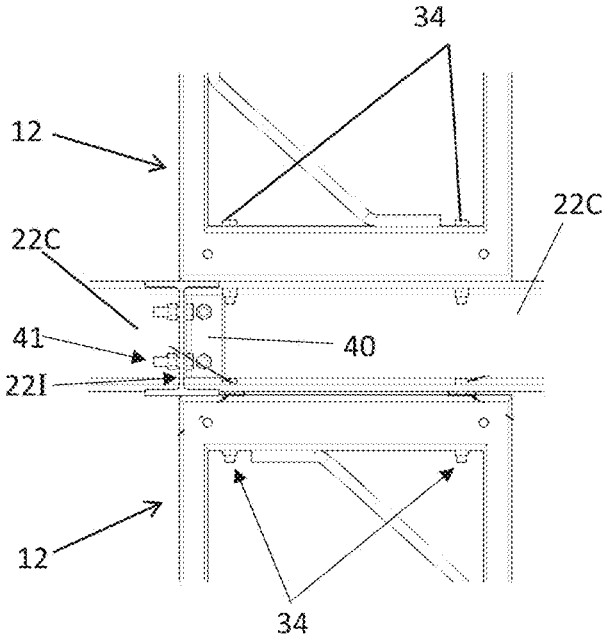

FIG. 14B illustrates the mounting of upper and lower truss columns 12 to e.g. a C-beam 22C, adjacent to a junction with an I-beam 22I. When FIG. 14A is compared to FIG. 14B, it can be seen that the two bolts 42 for mounting each truss column 12 to the foundation 14 are dimensionally larger than the bolts 34 used to connect the upper and lower truss columns 12 to beams 22. In this respect, the bolted connections are sized according to the type and magnitude of loads each of the components is designed to support.

Figure 16:
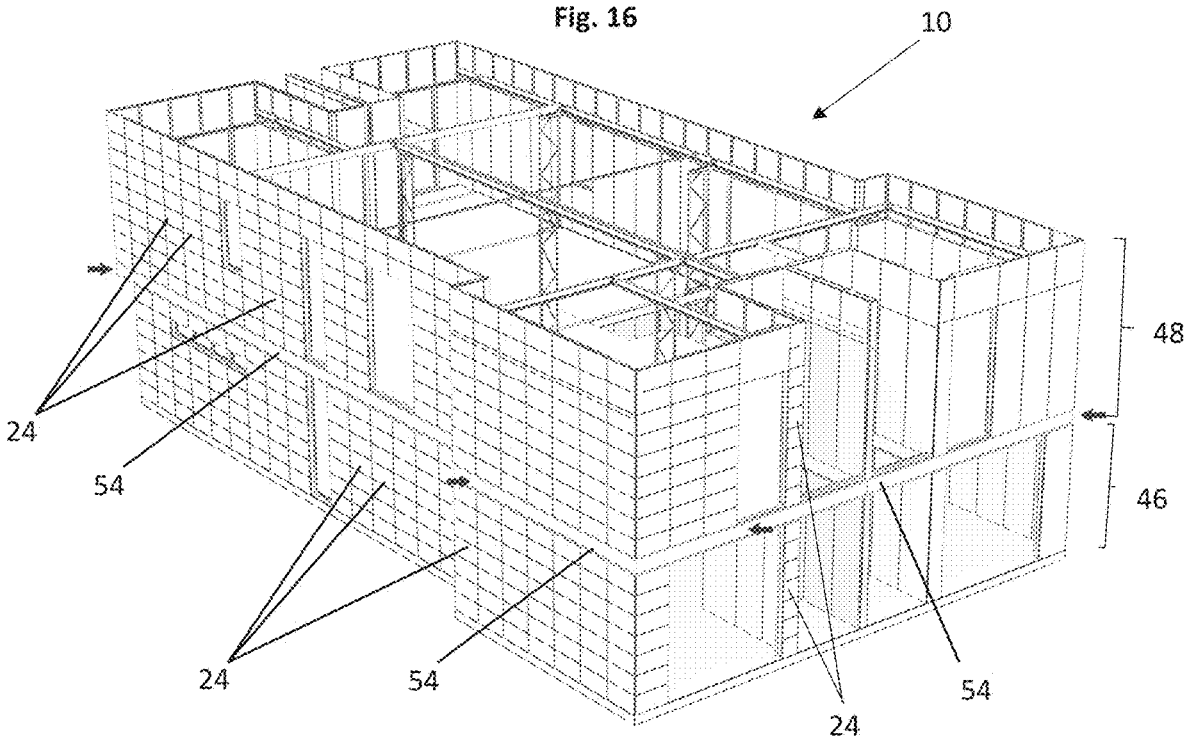
FIG. 16 shows perspective view of a load bearing system for a near-complete assembled multi-storey residential structure.

Referring now to FIGS. 15 and 16, a multi-storey residential structure is shown that comprises an arrangement and assembly of an overlying upper storey 48 with respect to an underlying lower storey 46. The truss columns 12 and the beams 22 of lower storey 46 are arranged to support the truss columns 12 of the upper storey 48 as well as floor 44 of the upper storey 48. Typically, for optimal load transfer, a high proportion of the lower storey truss columns 12L are directly vertically aligned under the upper storey truss columns 12U, as shown. In the form shown, the truss columns 12 and beams 22 of the upper storey 48 are arranged to support a roof at location 50 of the residential structure 10. Also, while FIG. 15 shows a single overlying storey (two-storey structure), it is anticipated that further overlying storeys, e.g. three, four, etc, can be constructed. As necessary, various of the components can be re-sized and/or 'doubled-up' to support the increased loads of a 3+ storey residential structure.

In FIGS. 15 and 16, the overlying storey of the residential structure also comprises façade panels 24 mounted around the perimeter of the residential structure (FIG. 15 only shows one such panel 24 for each of the lower storey 46 and upper storey 48 whereas FIG. 16 shows all the façade panels 24 installed and in place). The façade panels 24 of the lower storey 46 extend between the foundation 14 and a beam 22 that is intermediate the lower and upper storey. The façade panels 24 of the upper storey 48 extend between the floor 44 and an uppermost beam 22 of the upper storey.

FIG. 16 also shows the fascia panels 54 in-use, mounted to the residential structure between the lower storey 46 and upper storey 48. Each fascia panel 54 is arranged to locate between the external surface 29 of the lower and upper façade panels 24 such that the adjacent external surfaces 29 and fascia panel 54 are flush. This provides a continuous surface transition between the adjacent surfaces. This flush arrangement can also allow a separate surface finish (e.g. render such as stucco material) to be applied to the external wall of the residential structure (e.g. from the foundation up the roof).

Figure 17A:
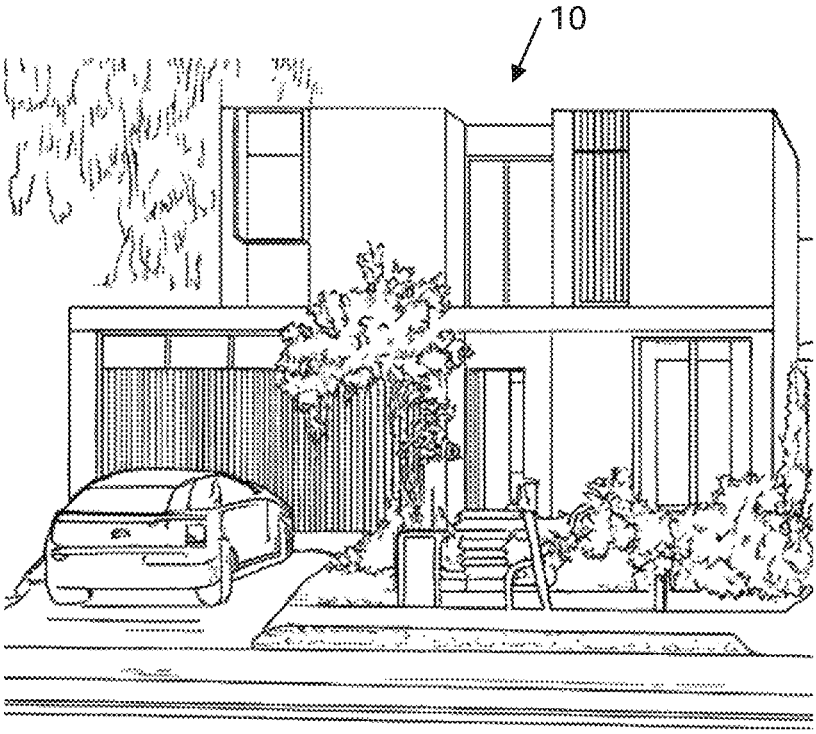
FIGS. 17A and 17B shows rendered images of a multi-storey residential structure and a duplex-type residential structure, respectively.
Figure 17B:
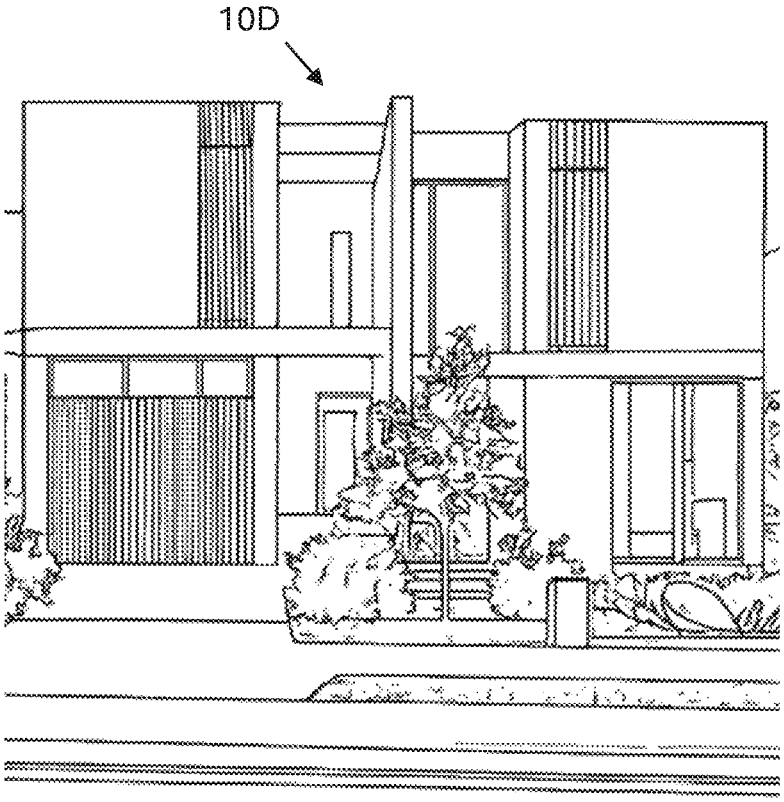

The multi-storey residential structure 10 can also be configured as duplex-type structure. FIG. 17A illustrates a rendered image of a fully-built multi-storey residential structure 10 and FIG. 17B illustrates a rendered image of a fully-built duplex-type structure 10D.

As set forth above, the truss columns 12 and beams 22 can be arranged to form a single-storey residential structure (i.e. a single level structure). In this case, a roof is supported by the arrangement of truss columns 12 and beams 22 of the single (i.e. lower/ground) storey as shown in FIG. 1. A roof can be mounted with respect to the beams 22 of the single-storey structure. As discussed previously (and with reference to FIG. 3), if e.g. floor-to-ceiling windows, etc. are desired, roof ties 19 can be provided that extend between two beams 22 to complete the ring-like structure and to tie together and stabilise opposing walls of the residential structure until the windows, etc. and roof are secured in place.

Figure 18:
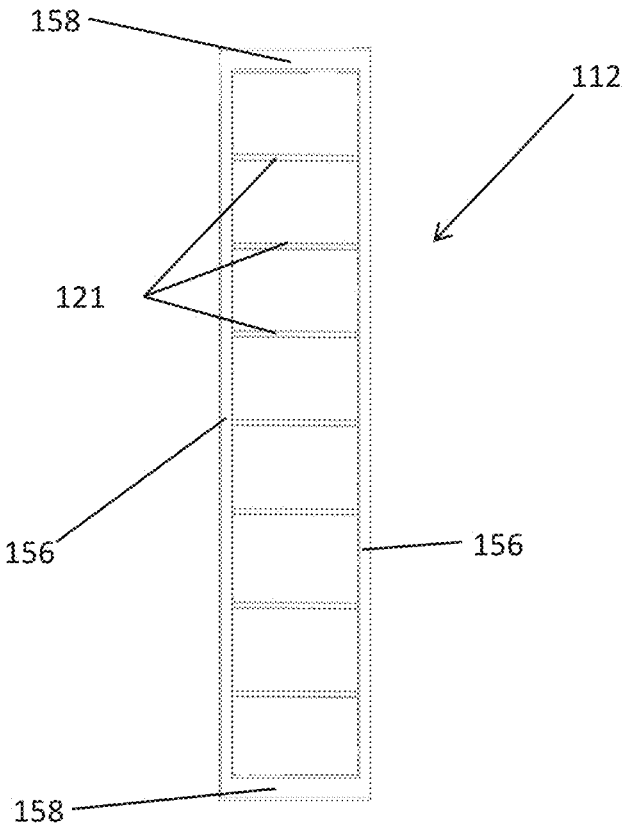
FIG. 18 shows an alternative embodiment of a structural load bearing column of a load bearing system for a residential structure.

Referring now to FIG. 18, an alternative embodiment of the truss column is referenced as 112. In truss column 112, the internal bracing elements take the form of a number of spaced, horizontal rods 121 (or bars, members etc) to be connected between (and e.g. welded to) the vertical members 156. In this form, the rods 121 are, in-use, horizontal relative to the vertical members 156, with the horizontal rods 121 being orientated parallel with the top and bottom chords 158. This gives the truss column 112 a 'ladder-like' appearance.

Figure 19A:
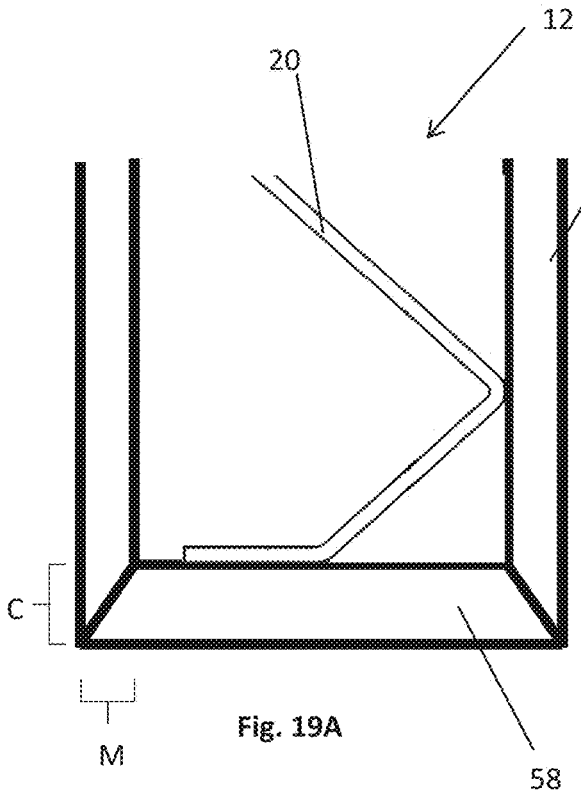
FIGS. 19A and 19B show embodiments of a structural load bearing column of a load bearing system for a residential structure.
Figure 19B:
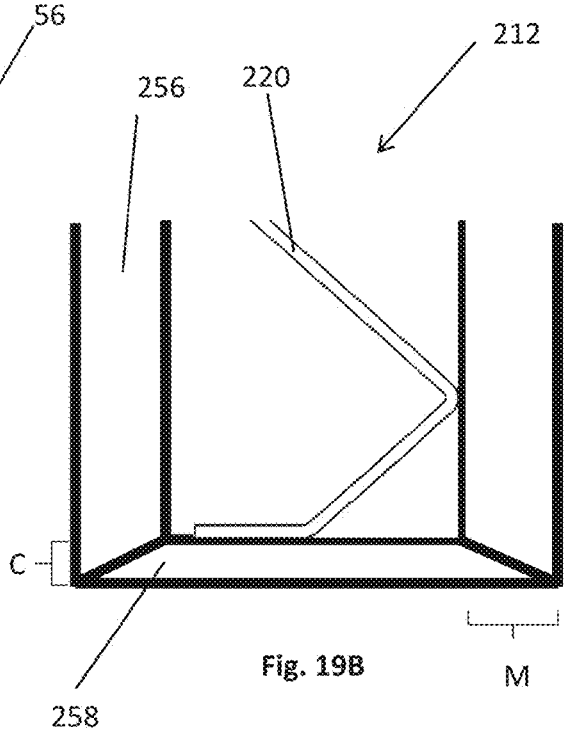

FIG. 19A shows a detail of a lower portion of the truss column 12 of FIGS. 7 and 8. FIG. 19B shows an alternative embodiment of the truss column 212, also detailing a lower portion of the column. In truss column 212, the bottom-to-top height C of each of the top and bottom chords 258 is less than the side-to-side width M of the vertical members 256. It can be seen that, by comparing FIG. 19A and FIG. 19B, the bottom-to-top height C of chord 58 is larger than chord 258. Similarly, the side-to-side width M of the vertical member 56 is smaller than the vertical member 256. This is to illustrate that the dimensions of the vertical members and top and bottom chords of the truss columns can be adjusted to suit the design requirements of the column. That is, for some residential structures, the vertical members can have smaller or larger cross-section relative to the chords. In addition, the side-to-side width of the vertical members can be the same size as the bottom-to-top height of the chords. Thus, the vertical members and chords can be sized according to specific loading conditions of a given site.

Figure 20A:
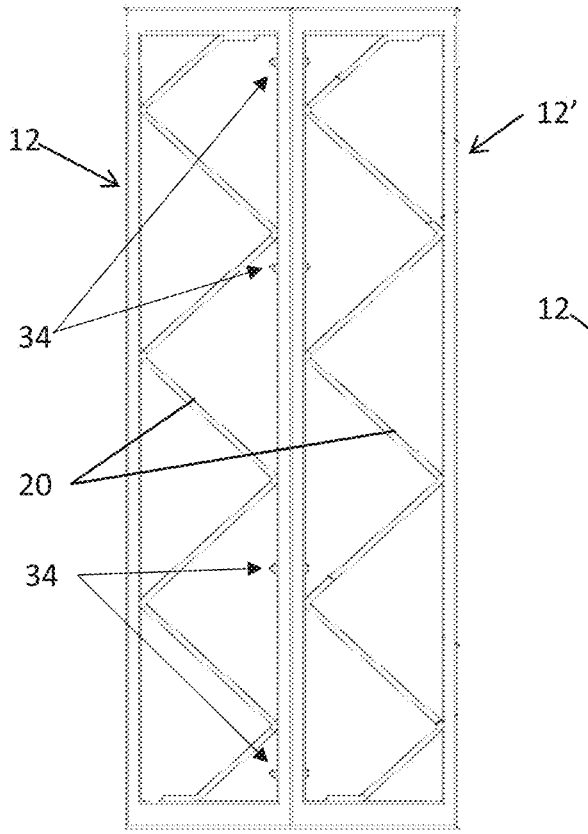
FIGS. 20A and 20B show variations in arrangements of structural load bearing columns of a load bearing system for a residential structure.
Figure 20B:
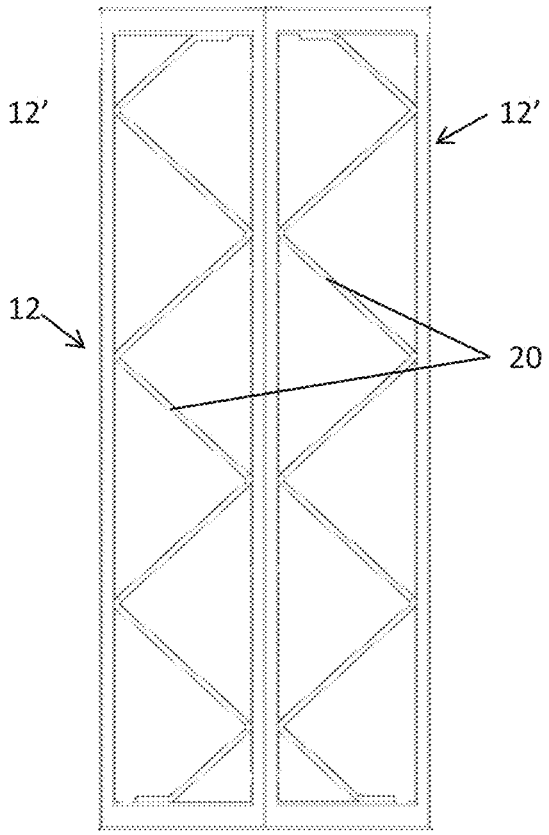

Referring now to FIGS. 20A and 20B, because the series of apertures 69 along each of the opposing vertical members 56 is identical, the truss column 12 and an adjoining truss column 12' can be mounted together side-by-side, on either side thereof, or with one truss column 12' reversed (FIG. 20B). In FIG. 20A, the truss brace 20 of truss column 12 has the same orientation as truss column 12'. In FIG. 20B, the truss brace 20 of truss column 12 has a 'mirrored' orientation to the truss brace 20 of truss column 12'. Also, the mirrored series of apertures 69 and the zig-zag configuration of truss brace 20, allows one of the truss columns 12 to be inverted relative to truss column 12'. This can provide for ease of installation of the columns in a residential structure. For example, columns can be mounted to e.g. foundation 14 in either orientation 12 or 12' as illustrated in FIG. 20A or 20B.

Referring now to FIGS. 21A to 21J, a method of construction (installation sequence) for the residential structure 10 will now be described. This method describes the construction of a two-storey structure, with a single storey structure being a simplified version of the two-storey installation methodology.

Figure 21A:
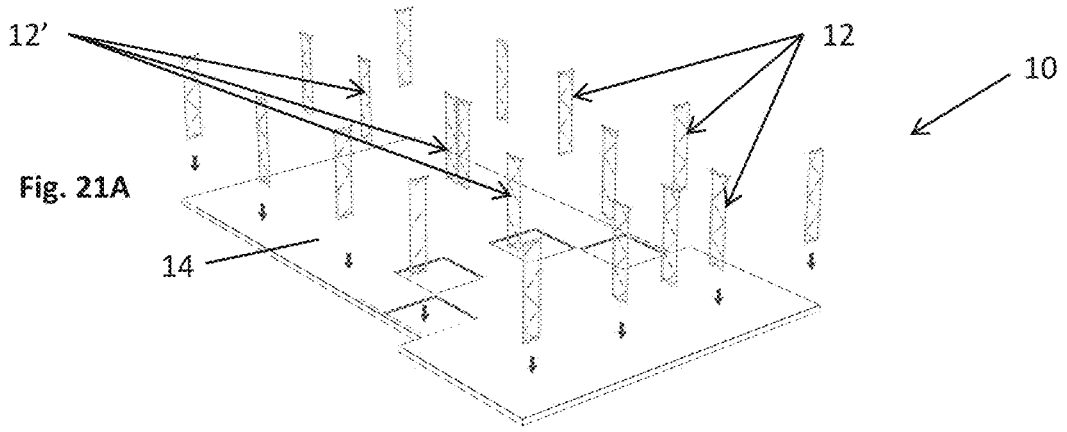
FIGS. 21A to 21J show an assembly sequence for construction of load bearing system for a multi-storey residential structure.

In FIG. 21A, the foundation 14 of the residential structure is first laid (e.g. poured) to form the ground floor. The foundation 14 is typically formed of concrete, but a timber or steel framework construction can be employed instead. A plurality of truss columns 12 (i.e. ground floor columns) are then bolted 47 at their lower ends to the foundation 14. Some of the truss columns 12 are mounted at a perimeter of the foundation, whereby the columns are just inset from an edge 21 of the perimeter. Other truss columns 12' are mounted at intermediate locations of the foundation 14, whereby the columns are spaced away from edge 21 and are arranged closer to a middle of the foundation. Usually the columns are arranged according to a predetermined, pre-planned layout.

Figure 21B:
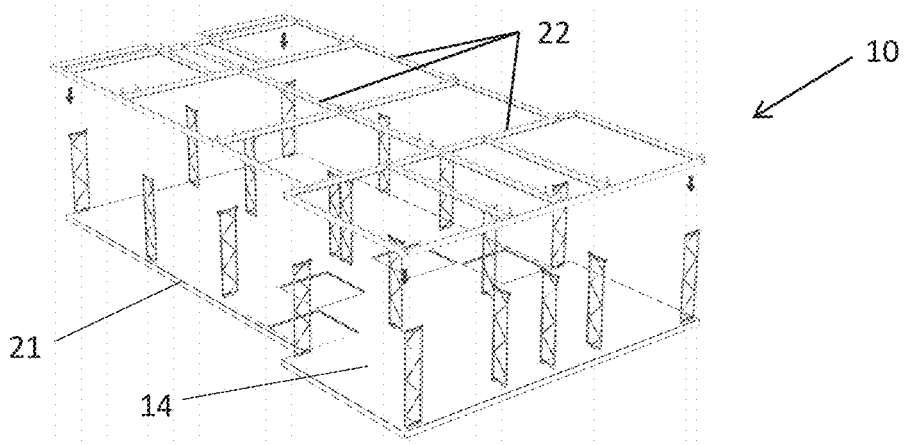
Figure 21C:
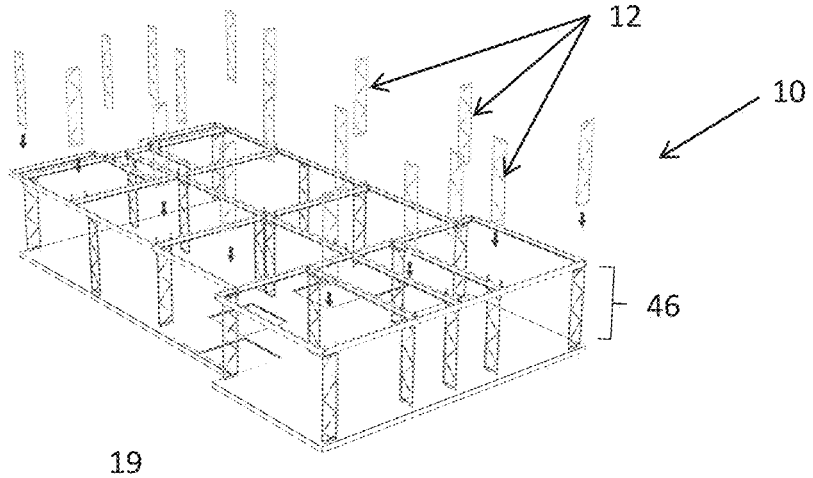

Referring next to FIG. 21B, with each of the ground floor truss columns 12 having been secured to the foundation 14, the beams 22 are now connected with respect to upper ends of the truss columns using by a bolted connection (e.g. 34 and via brackets 66). The beams 22 are prefabricated and are typically pre-sized and pre-drilled with apertures to correspond to apertures 70 in the truss columns 12. As shown in FIG. 21C, each of the 22 beams typically extends between the upper ends of adjacent truss columns 12 (i.e. from one truss column to the next). The resultant mounted beams 22 define a plurality of closed perimeters (i.e. ring-like, closed-loop arrangements) at the upper ends of the truss columns 12 to form a supporting framework for the first or lower floor (i.e. lower storey 46) of the residential structure 10.

Figure 21D:
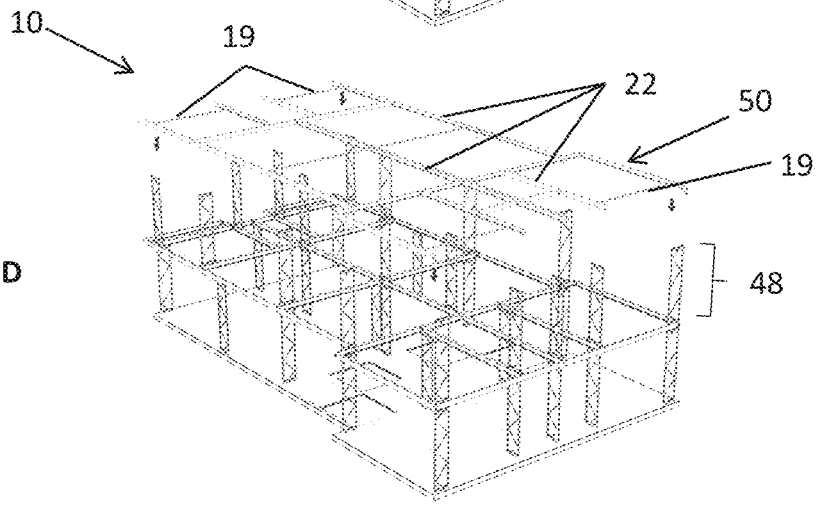

Referring now to FIG. 21C, a plurality of truss columns 12 for the upper storey 48 are next mounted to the underlying beams 22 of the lower storey 46. Stabilising brackets 66 can be employed as required, or the truss columns 12 can be 'free-standing' via the bolted connections 120. As illustrated by FIG. 21D, the upper storey beams 22 are then connected with respect to upper ends of the truss columns using a bolted connection (e.g. 34 and via brackets 66). Again, as shown in FIG. 21E, the beams 22 are arranged to define a plurality of closed perimeters (i.e. ring-like, closed-loop arrangements) at the upper ends of the upper storey truss columns 12 to provide a supporting framework for upper storey walls and for a roof at location 50 of the residential structure.

The upper storey 58 can also employ roof ties 19 (e.g. in locations where floor to ceiling windows, etc. are to be employed). The roof ties 19 'close the loops' of the upper storey framework to provide structural support to the residential structure 10. Typically, the roof to be located at 50 is a flat roof, however, the roof can be a pitched roof or other variation.

Figure 21E:
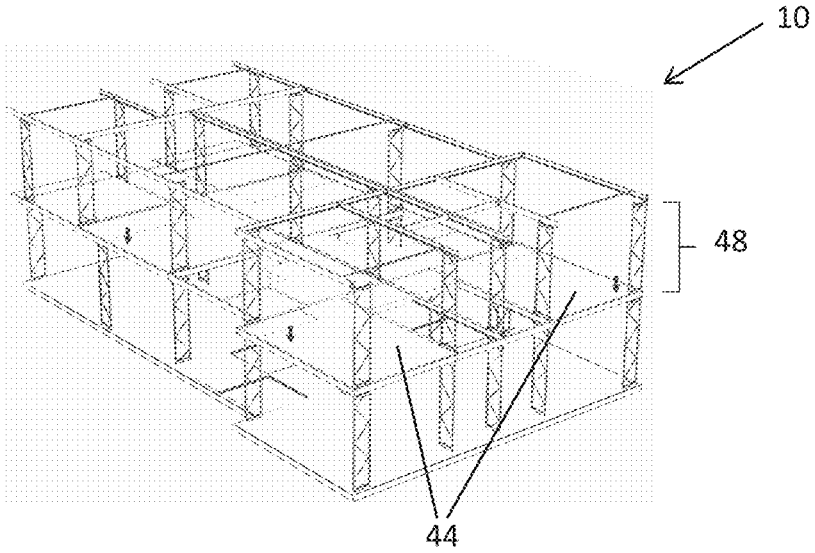

Referring now to FIG. 21E, an upper storey floor 44 is next installed to extend between the beams 22 and truss columns 12 located at the junction of the upper and lower storeys 48, 46. It is noted that, at this stage of the construction, the roof can be installed before the floor 44 is installed (e.g. if it is desirable to have a protective cover for the floor 44). Where the floor 44 is to be formed of concrete, formwork decking 52 can mounted to extend between the beams 22 that form a perimeter of each room. Concrete for the floor 44 is then poured. As required, storey, the decking 52 can be propped by conventional means to support the load applied by the poured concrete as it cures. Instead of formwork decking, a framework-type floor support structure can be installed at 44 (e.g. of timber and/or steel) and then conventional flooring systems (e.g. floor boards and/or panels) can be installed.

In other forms, the roof can be installed at 50 after at least the floor support structure has been installed or after concrete pouring. In either case, installation of the roof helps to facilitate 'lock-up' of the residential structure at an early stage of the construction process.

Figure 21F:
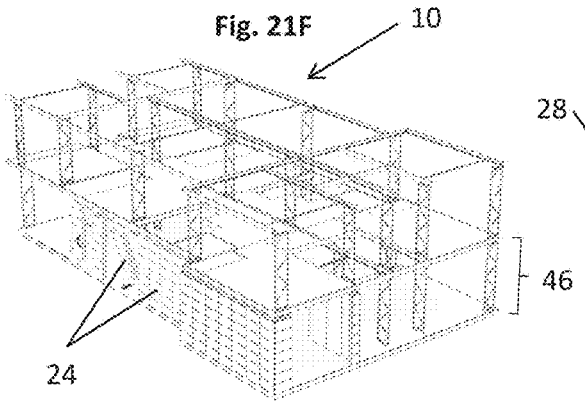
Figure 21G:
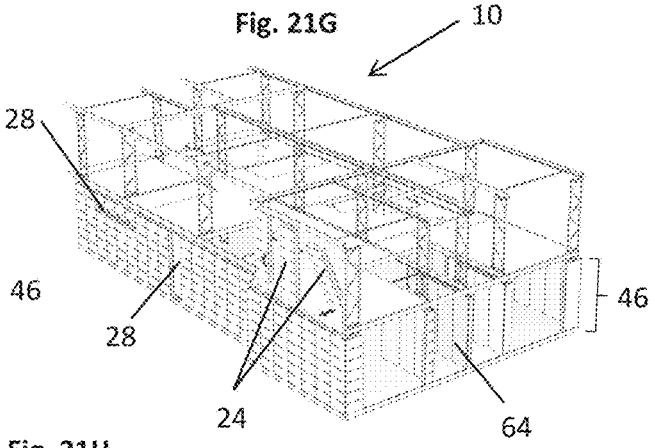
Figure 21H:
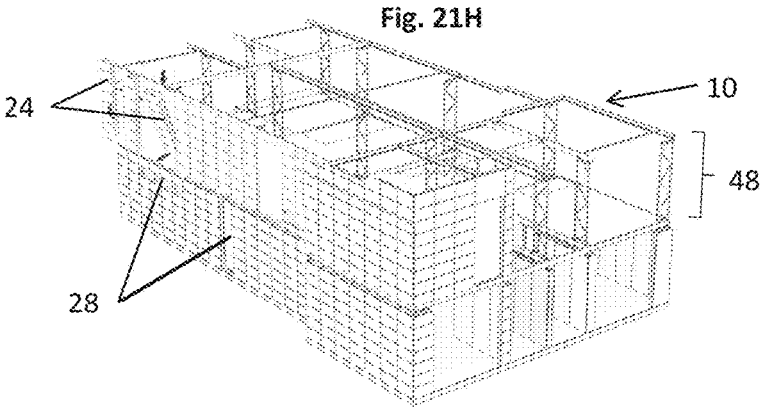

Reference is now made to FIGS. 21F, 21G and 21H, which illustrate a sequence of mounting of external cladding in the form of a plurality of façade panels 24 to the perimeter of the residential structure 10. As shown in FIG. 21F, a plurality of façade panels 24 are first installed in sequence to the framework for the lower storey 46 (i.e. ground floor). The lower storey façade panels 24 are each mounted to the sub-sill 32F located at the foundation 14, and then the sub-head 30 is located in place and mounted with respect to the beams 22 via the fascia beam 35, as previously described. Typically, the lower storey façade panels 24 are each lifted into place such as via an on-site crane. Alternatively, the façade panels can be lifted by a person from the inside of the residential structure. FIG. 21G shows the fully installed façade panels 24 for the upper storey 48.

It is noted that the illustrations of façade panel installation in FIGS. 21F, 21G and 21H is schematic, in that they depict the panels 24 being installed vertically, i.e. in a sliding motion from the roof to the foundation. Typically, this is not the precise installation method used to install the panels 24. A specific method for installing the panels is described below with reference to FIG. 22.

During the installation of the façade panels 24, fittings, such as windows 28, are incorporated into the walls of the residential structure. As described previously, the windows 28 can be integrated (i.e. prefabricated) into the façade panels 24, or can be arranged and mounted between two façade panel portions. Façade panels 24 can be omitted to accommodate e.g. doorways 64, curtain windows 29, curtain walls, etc.

Figure 21I:
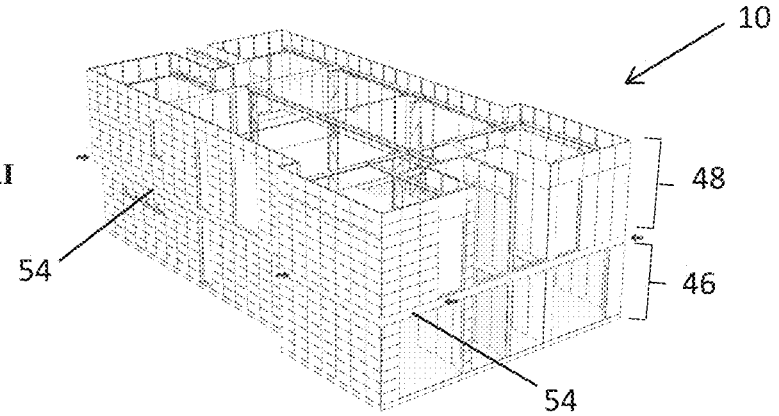

Referring to FIG. 21I, fascia panels 54 can now be mounted to locate between the lower (ground) storey 46 and upper (first floor) storey 48 to conceal the fascia beam 35 and beams 22. Fascia panels can also be mounted to locate between the upper (first floor) storey 48 and the roof at location 50. The method of mounting the fascia panels 54 is as outlined above.

Figure 21J:
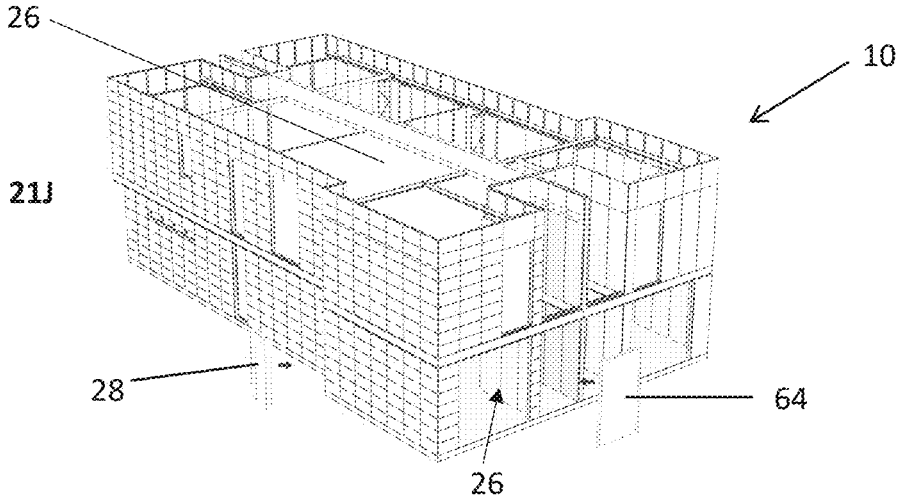

Referring now to FIG. 21J, at each of the lower (ground) storey 46 and upper (first floor) storey 48, internal cladding 26 is now mounted with respect to the plurality of truss columns 12. As above, the internal cladding 26 can be mounted with respect to the plurality of truss columns 12 via a top hat batten system. In this way, each truss column 12 becomes incorporated into (i.e. hidden within) a respective wall of the residential structure (e.g. between the façade panels 24 and internal cladding 26—external wall; or between two internal cladding panels—internal wall; or between two façade panels 24—external/internal wall).

Further, and as described above, doorways 64, floor-to-ceiling windows 21, curtain windows, curtain walls, etc. can be mounted at locations where cladding panels have been omitted.

Once installed, the façade panels 24 can be preconfigured or treated post-installation with various surface finishes, including e.g. a variety of rock-like materials, plaques, plate, metal, timber, glass, polymer, marble-like finishes, cement render, stucco, etc.

Figure 22:
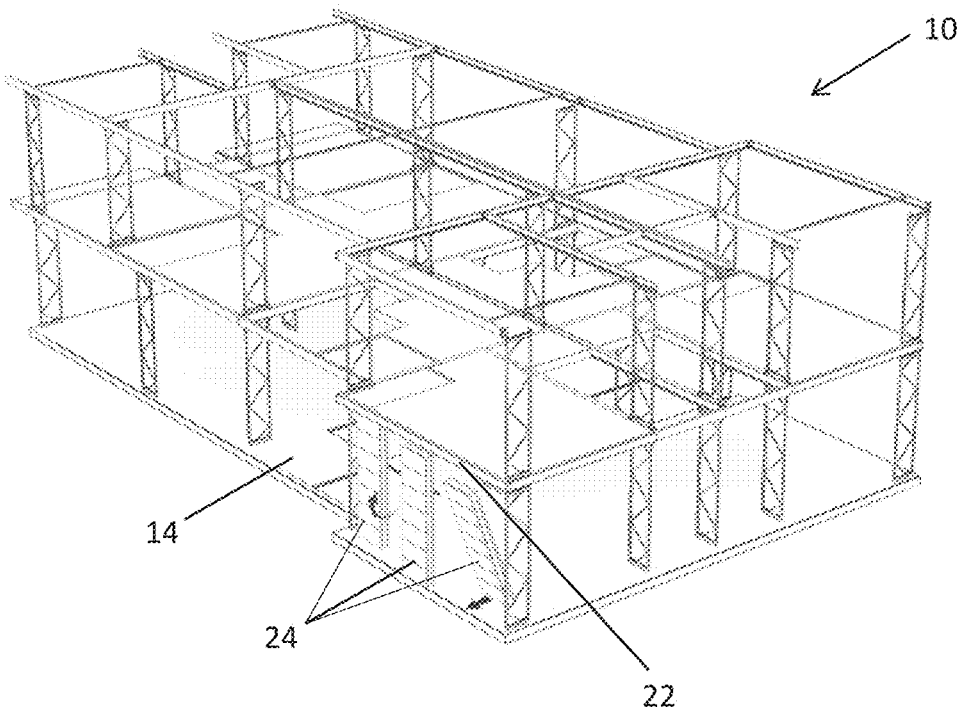
FIG. 22 shows an installation sequence for a cladding panel into a load bearing system for a residential structure.

Referring now to FIG. 22, the façade panels 24 are installed according to the following methodology. Firstly, the panel 24 is brought towards the perimeter of the foundation 14 and an upper end is moved beneath an overlying beam 22 such that the upper end is tilted towards an outside of the structure 10. A lower end of the panel 24 is mounted, i.e. nested, in the sub-sill 32F located at the foundation 14 before the upper end of the panel 24 is moved back towards the overlying beam 22, the panel 24 being rotated about its mounting at the sub-sill. The panel upper end is moved towards beam 22 and is manoeuvred into engagement with the sub-head 30.

When installing panels 24 in a single storey structure, or in an upper-most floor of a multi-storey structure, the panels 24 are installed with substantially the same methodology described above, primarily differing in how the upper end of the panel 24 is mounted to the structure. In this case, i.e. when installing a panel with respect to the roof, once the panel 24 is nested in the sub-sill 32F and moved back towards the overlying beam 22, the panel 24 is brought into contact with the L-bracket 35S mounted to beam 22. The panel 24 can be mounted e.g. screwed or bolted to the bracket 35S so as to secure the upper end of the panel to the residential structure.

As set forth above, the truss columns 12 and beams 22 of the upper storey 48 can be arranged in the same or a similar way to the truss columns 12 and beams 22 of the lower storey 46. As illustrated in FIG. 15, some of the truss columns 12 and beams 22 can be located in different positions, for example, when differently shaped and configured rooms are required on the upper storey 48. Further, some of the beams 22 and truss columns 12 can be omitted or orientated differently between the lower storey 46 and upper story 48. This can allow for different configurations of e.g. rooms, corridors, stairwells, etc. to be formed at each of the floors/storeys.

The load bearing system as described above, including truss columns 12, beams 22 and façade panels 24, together with the additional components (e.g. external supports 29, fascia panels 54, brackets 66, etc, can be prefabricated and pre-sized such that they can be transported as a smaller (e.g. flat) package for installation at a worksite. For example, the components can be supplied as a kit, included with mounting elements such as bolts, tools, instructions for assembly onsite, etc.

It is anticipated that the abovementioned kit, having releasable mountings, e.g. bolted connections, can be disassembled so as to deconstruct the residential structure. In this way, at least some of the components, e.g. beams, columns etc, of the structure can be recycled/reused in a further residential structure. Or, the residential structure can be moved to a new site.

Variations and modifications may be made to the parts previously described without departing from the spirit or ambit of the disclosure.

For example, a load bearing truss column can be supplied that comprises internal bracing elements arranged in a zig-zag formation as described above, together with bracing elements arranged horizontally, as described above.

Further, each of the sub-head 30 and sub-sills 32, 32F can be mounted to the beam and foundation, respectively, by a releasable (e.g. bolted) connection. Alternatively, the sub-head 30 and sub-sill 32 can be fixably mounted to the beam 22 by e.g. a welded connection. Each of the sub-head 30 and sub-sill 32 can be releasably mounted to the truss columns 12 by bolted connections.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the load-bearing system.

The invention claimed is:

1. A load bearing system for a residential structure comprising:

a plurality of structural load bearing columns, each column configured to be mounted to a foundation of the residential structure in spaced relation to one another, each column comprising:

a periphery defined by hollow-section members, the periphery comprising opposing in-use vertical members and opposing in-use top and bottom chords, wherein a lower end region of each column is configured to be connected to the foundation of the residential structure and an upper end region of the column is configured to be connected to an overlying part of the residential structure;

one or more internal bracing elements extending between the hollow-section members; and a plurality of beams extending between and connected to the upper end region of the structural load bearing columns, the plurality of beams being arranged end-to-end defining a closed perimeter extending around the upper end regions of the structural load bearing columns.

2. A load bearing system for a residential structure comprising:

two or more structural load bearing columns, each column configured to be mounted to a foundation of the residential structure in spaced relation to one another, each column comprising:

a periphery defined by hollow-section members, the periphery comprising opposing in-use vertical members and opposing in-use top and bottom chords, wherein a lower end region of each column is configured to be connected to the foundation of the residential structure and an upper end region of the column is configured to be connected to an overlying part of the residential structure; and one or more internal bracing elements extending between the hollow-section members;

at least one beam extending between and connected to the upper end region of the two or more structural load bearing columns; and at least one cladding panel mounted to and extending between the foundation of the residential structure and the at least one beam.

3. The load bearing system according to claim 2, wherein the system comprises at least four columns configured to be mounted to the foundation in spaced relation to each other, and at least four beams, each beam extending between and connected to the upper end region of at least two of the four columns, and wherein cladding panels are mounted to extend between the foundation and at least one of the at least four beams.

4. The load bearing system according to claim 2, wherein each of the two or more columns is elongate and rectangular-shaped in front elevation, each column having a side-to-side width that is greater than a front-to-back depth thereof.

5. The load bearing system according to claim 2, wherein an in-use upper end of each of the two or more columns is coupled to the at least one beam via at least one bracket, wherein a roof is mounted to the at least one beam; or wherein a formwork structure for a floor of an overlying storey is mounted with the at least one beam; or wherein a floor support structure is mounted to the at least one beam.

6. The load bearing system according to claim 2, wherein each of the two or more columns is elongate, each column having a depth configured to be arranged in use inboard of the at least one cladding panel whereby the at least one cladding panel locates at a front face of the column, and whereby each of the two or more columns is able to be incorporated into a wall of the residential structure.

7. The load bearing system according to claim 6, the system further comprising internal cladding, the internal cladding able to be mounted to a back face of each of the two or more columns, whereby each column is able to be incorporated into the wall of the residential structure defined by the at least one cladding panel and the internal cladding.

8. The load bearing system according to claim 2, wherein the two or more columns and the at least one beam are arranged in use to support: (i) a roof of the residential structure; or (ii) a floor of an overlying storey of the residential structure.

9. The load bearing system according to claim 8, wherein the residential structure is a single-storey structure, wherein for (i) an in-use upper end of the at least one cladding panel for the single-storey structure is mounted to the at least one beam arranged in use to support the roof.

10. The load bearing system according to claim 9, wherein for (i) at least one intermediate beam is mounted to the at least one beam arranged in use to support the roof of the single-storey structure, the at least one intermediate beam arranged to support the in-use upper end of the at least one cladding panel such that the at least one cladding panel is mounted to the at least one intermediate beam.

11. The load bearing system according to claim 10, wherein for (i) the at least one intermediate beam arranged at the at least one beam supporting the roof is an L-shaped bracket and the at least one beam supporting the roof is a C-channel, the at least one L-shaped bracket being mounted flange-to-flange to the at least one beam supporting the roof, the at least one L-shaped bracket and the at least one beam supporting the roof each configured such that in-use horizontal positioning of the at least one L-shaped bracket to the at least one beam supporting the roof is adjustable, and the at least one L-shaped bracket configured such that in-use vertical positioning of the at least one cladding panel is adjustable.

12. The load bearing system according to claim 8, wherein the residential structure is a multi-storey structure, wherein for (ii):

an in-use upper end of the at least one cladding panel for an underlying-storey is mounted to the at least one beam via a sub-head, the at least one beam arranged in use to support the floor of the overlying storey, the sub-head being mounted to the at least one beam; and an in-use lower end of an at least one cladding panel for the overlying-storey is mounted to the at least one beam via a sub-sill, the sub-sill being mounted to the at least one beam.

13. The load bearing system according to claim 12, wherein the overlying storey is also formed from two or more columns, the at least one beam connected to an upper end region of the two or more columns, and at least one cladding panel mounted to extend between the floor of the overlying storey and the at least one beam.

14. The load bearing system according to claim 12, wherein for (ii), at least one intermediate beam is mounted to the at least one beam arranged in use to support the floor of the overlying storey the at least one intermediate beam arranged at the at least one beam supporting the overlying floor and arranged to support the sub-head and sub-sill for the at least one cladding panel such that the least one cladding panel underlies the at least one intermediate beam and at least one cladding panel is supported above the intermediate beam; or wherein for (ii), the at least one intermediate beam is a fascia beam, the at least one fascia beam being mounted to the at least one beam supporting the floor of the overlying storey, the fascia beam being arranged to support a sub-sill for an overlying at least one cladding panel of the overlying storey, and to support a sub-head for an underlying at least one cladding panel of the underlying storey.

15. The load bearing system according to claim 14, wherein for (ii) the at least one fascia beam and the at least one beam supporting the overlying storey are each a C-channel, and wherein the at least one fascia beam is mounted back-to-back to the at least one beam supporting the overlying storey and wherein the at least one fascia beam and the at least one beam supporting the overlying storey are each configured such that in-use vertical positioning of the at least one fascia beam to the at least one beam supporting the overlying storey is adjustable.

16. The load bearing system according to claim 12, wherein for (i), the in-use upper end of the at least one cladding panel for the overlying-storey is mounted to the at least one beam for the overlying storey, the at least one overlying beam arranged in use to support the roof.

17. The load bearing system according to claim 16, wherein for (i), at least one intermediate beam is mounted to at least one overlying beam arranged in use to support the roof of the multi-storey structure, the at least one intermediate beam arranged to support the in-use upper end of the at least one cladding panel for the overlying-storey such that the at least one cladding panel is mounted to the at least one intermediate beam.

18. The load bearing system according to claim 17, wherein for (i) the at least one intermediate beam arranged at the at least one overlying beam supporting the roof is an L-shaped bracket and the at least one overlying beam is a C-channel, the at least one L-shaped bracket being mounted flange-to-flange to the at least one overlying beam, the at least one L-shaped bracket and the at least one overlying beam supporting the roof each configured such that in-use horizontal positioning of the at least one L-shaped bracket to the at least one overlying beam is adjustable, and the at least one L-shaped bracket configured such that in-use vertical positioning of the at least one cladding panel for the overlying-storey is adjustable.

19. A method for constructing a residential structure, the method comprising:

providing the system according to claim 1;

mounting an in-use lower end of each of the plurality of structural load bearing columns to the foundation supporting the residential structure; and securing the plurality of beams to extend between and be connected to the upper end region of the plurality of structural load bearing columns.

* * * * *